US007817956B2

(12) United States Patent
Sugimoto

(10) Patent No.: US 7,817,956 B2
(45) Date of Patent: Oct. 19, 2010

(54) CLEANING BLADE FOR USE IN IMAGE-FORMING APPARATUS

(75) Inventor: Mutsuki Sugimoto, Hyogo (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 489 days.

(21) Appl. No.: 11/905,497

(22) Filed: Oct. 1, 2007

(65) Prior Publication Data

US 2008/0080914 A1 Apr. 3, 2008

(30) Foreign Application Priority Data

Oct. 2, 2006 (JP) ..... 2006-271104
Oct. 3, 2006 (JP) ..... 2006-271537

(51) Int. Cl.
*G03G 21/00* (2006.01)

(52) U.S. Cl. ..... 399/350; 399/343

(58) Field of Classification Search ..... 399/343, 399/350

See application file for complete search history.

(56) References Cited

U.S. PATENT DOCUMENTS

2005/0254868 A1* 11/2005 Naruse et al. ..... 399/350
2006/0099016 A1 5/2006 Watanabe et al.

FOREIGN PATENT DOCUMENTS

JP 2004-361844 A 12/2004
JP 2006-053514 A 2/2006
JP 2006-154747 A 6/2006

* cited by examiner

*Primary Examiner*—Ryan D Walsh
(74) *Attorney, Agent, or Firm*—Birch, Stewart, Kolasch & Birch, LLP

(57) ABSTRACT

A cleaning blade which is brought into contact with a peripheral surface of a photoreceptor drum of an image-forming apparatus to remove toner which remains on the peripheral surface of the photoreceptor drum. In a dynamic state in which the cleaning blade contacts the photoreceptor drum with a load of 2 to 60 N and a face pressure of 1.3 to 66.7 MPa being applied thereto when the photoreceptor drum is rotating, the cleaning blade contacts the peripheral surface of the photoreceptor drum in a contact width (nip width) of 3 to 10 μm. The cleaning blade has a two-layer construction composed of a matrix layer and an edge layer.

12 Claims, 9 Drawing Sheets

CLEANING BLADE FOR USE IN IMAGE-FORMING APPARATUS

This Nonprovisional application claims priority under 35 U.S.C. §119(a) on Patent Application No(s). 2006-271104 filed in Japan on Oct. 2, 2006 and 2006-271537 filed in Japan on Oct. 3, 2006, the entire contents of which are hereby incorporated by reference.

BACKGROUND OF THE INVENTION

Field of the Invention

The present invention relates to a cleaning blade for use in an image-forming apparatus and more particularly to a cleaning blade intended to improve the performance of removing toner which remains on the surface of a photoreceptor drum by adjusting the nip width of the cleaning blade which contacts the rotating photoreceptor drum.

In an electrostatic photocopying machine in which plain paper is used as recording paper, a copying operation is performed as follows: an electrostatic charge is applied to the surface of a photoreceptor drum by discharge, an image is exposed to the photoreceptor drum to form an electrostatic latent image thereon, toner having an opposite polarity is attached to the electrostatic latent image to develop the electrostatic latent image, a toner image is transferred to recording paper, and the recording paper to which the toner image has been transferred is heated under pressure to fix the toner to the recording paper. Therefore to sequentially copy the image of an original document on a plurality of sheets of recording paper, it is necessary to remove the toner which remains on the surface of the photoreceptor drum after the toner image is transferred to the recording paper from the photoreceptor drum in the above-described processes.

As a method of removing the toner which remains on the surface of the photoreceptor drum, a blade cleaning method of sliding a cleaning blade in contact with the surface of the photoreceptor drum, with the cleaning blade being pressed against the surface of the photoreceptor drum is known.

The conventional cleaning blade used in the above-described method is composed of an elastic member to remove pulverized toner or polymerized toner treated into a deformed state from the photoreceptor drum. The present tendency is to save energy, reduce the cost of the image-forming apparatus, and form a high-quality image. That being the case, spherical polymerized toner having a small diameter has been developed. As a result, unless the cleaning blade slidingly contacts the photoreceptor drum by applying a load to the cleaning blade, it is difficult to remove toner that remains on the surface of the photoreceptor drum. Thereby the toner is cleaned faultily.

Consequently in a cleaning apparatus of the photoreceptor drum of an image-forming apparatus, the load of the cleaning blade which slidingly contacts the photoreceptor drum is controlled. The load is conventionally set as "linear pressure (N/cm)". The linear pressure means a value obtained by dividing a total load applied to the cleaning blade by the length of a ridgeline thereof on the assumption that the cleaning blade makes a line contact with the photoreceptor drum.

Actually the cleaning blade makes not a line contact but a face contact with the photoreceptor drum and thus has a nip width (contact width). Therefore unless the load of the cleaning blade to be applied to the photoreceptor drum is set not by "linear pressure" but by "face pressure", it is impossible to accurately evaluate the performance of the cleaning blade in the image-forming apparatus.

In Japanese Patent Application Laid-Open No. 2006-154747 (patent document 1), there is proposed a cleaning apparatus, having a low-pressure and high-face pressure cleaning construction, in which the angle forming the ridgeline portion disposed at the leading edge of the cleaning blade is obtuse, and the ridgeline portion disposed at the leading edge thereof is pressed against the member to be cleaned at not less than 2.0 MPa.

But in the patent document 1, the face pressure is obtained from the contact width in the static state in which the photoreceptor drum is not rotating. Thus the face pressure disclosed in the patent document 1 does not reflect the face pressure in a dynamic state in which the photoreceptor drum is rotating, namely, not the face pressure when the cleaning mechanism is operating.

When a conventional single-layer cleaning blade having a low hardness is used to follow fine irregularities on the surface of the photoreceptor, the edge of the cleaning blade cannot be pressed against the photoreceptor at a high pressure. Therefore a defective toner-removing performance is performed.

When the hardness of the cleaning blade is increased to increase the contact pressure of the edge against the photoreceptor, the flexibility of the cleaning blade is lost. As a result, the cleaning blade is incapable of following fine irregularities of the surface of the photoreceptor, which causes toner to pass the cleaning blade without being removed from the surface of the photoreceptor and thus causes defective toner-removing performance to be performed. Further when the hardness of the cleaning blade is increased, the cleaning blade becomes frail and is liable to be worn easily.

As described above, it is very difficult for the cleaning blade having the single-layer construction to follow the fine irregularities of the surface of the photoreceptor and obtain a sufficient toner-removing performance by increasing the contact pressure of the edge of the cleaning blade against the photoreceptor.

To compensate for the disadvantage of the cleaning blade having the single-layer construction and improve the cleaning performance for the spherical polymerized toner having a small diameter, various cleaning blades having a two-layer construction are proposed.

For example, as disclosed in Japanese Patent Application Laid-Open No. 2004-361844 (patent document 2), there is proposed a cleaning blade having the two-layer construction in which the member made of the synthetic resin having a high hardness is formed on at least the cleaning edge portion of the leaf spring member.

As another example, as disclosed in Japanese Patent Application Laid-Open No. 2006-053514 (patent document 3), there is proposed an image-forming apparatus in which the elastic property of the side of the elastic blade which contacts the photoreceptor and that of the side thereof which does not contact the photoreceptor are different from each other, and the value of the hardness (JISA Hs)/modulus of repulsion elasticity (%) is larger at the side of the elastic blade which contacts the photoreceptor than at the side thereof which does not contact the photoreceptor.

In the patent documents 2 and 3, the layer of each of the cleaning blades which contacts the photoreceptor is made of the material having a higher hardness than that of the material of the layer thereof which does not contact the photoreceptor. Therefore the cleaning blades are incapable of following fine irregularities of the surface of the photoreceptor. When the cleaning blades are used for the spherical polymerized toner having a small diameter, the toner passes the cleaning blades without being removed from the surface of the photoreceptor. Thus the cleaning blades do not have a sufficient toner-removing performance.

Further because the side of each of these cleaning blades which contact the photoreceptor is made of the material having a high hardness, the cleaning blades are frail and lack wear resistance. Thus the cleaning blades are incapable of providing a sufficient cleaning performance for a long time.

Patent document 1: Japanese Patent Application Laid-Open No. 2006-154747

Patent document 2: Japanese Patent Application Laid-Open No. 2004-361844

Patent document 3: Japanese Patent Application Laid-Open No. 2006-053514

SUMMARY OF THE INVENTION

The present invention has been made in view of the above-described problems. Therefore it is an object of the present invention to provide a cleaning blade which has properties capable of coping with a demand that the cleaning blade applies an appropriate pressure to a photoreceptor drum and a contradictory demand that the cleaning blade is elastic, and has a nip width appropriately adjusted so that the cleaning blade which contacts the rotating photoreceptor drum has improved performance of removing toner which remains on the surface of the photoreceptor drum.

To solve the above-described problems, the present invention provides a cleaning blade, for use in an image-forming apparatus, which is brought into contact with a peripheral surface of a photoreceptor drum of an image-forming apparatus to remove toner which remains on the peripheral surface of the photoreceptor drum, the cleaning blade being molded from a thermosetting elastomer composition containing a rubber component (1), a filler (2), and a crosslinking agent (3), the thermosetting elastomer composition essentially containing 5 to 60 parts by mass of zinc methacrylate (2*a*) or 5 to 60 parts by mass of a mixture (2*a*) of methacrylic acid and zinc oxide as the filler (2) for 100 parts by mass of the rubber component (1) or the thermosetting elastomer composition containing 10 to 75 parts by mass of a mixture (1*a*) of hydrogenated acrylonitrile-butadiene rubber serving as a base polymer thereof and the zinc methacrylate dispersed in the hydrogenated acrylonitrile-butadiene rubber in 100 parts by mass of the rubber component (1), wherein in a dynamic state in which the cleaning blade contacts the photoreceptor drum with a load of 2 to 60 N and a face pressure of 1.3 to 66.7 MPa being applied thereto when the photoreceptor drum is rotating, the cleaning blade contacts the peripheral surface of the photoreceptor drum in a contact width (nip width) of 3 to 10 μm.

In the present invention, as described above, as the filler (2), a predetermined amount of the zinc methacrylate (2*a*) or the mixture (2*a*) of the methacrylic acid and the zinc oxide (2*a*) is mixed with the rubber component (1). Alternatively a predetermined amount of the mixture (1*a*) of the H-NBR serving as the base polymer and the zinc methacrylate dispersed in the H-NBR is mixed with the rubber component (1). Thereby the co-crosslinking effect of the zinc methacrylate is displayed to improve the mechanical properties of the thermosetting elastomer composition so that the cleaning blade has a predetermined face pressure and elasticity. Furthermore because the mixing amount of the zinc methacrylate is set to the above-described range, an excessive reinforcing effect is not imparted to the thermosetting elastomer composition. Thereby the elastic function of the mechanical properties can prevent the hardness from becoming high and the tensile elongation from becoming low respectively.

In the dynamic state in which the cleaning blade composed of the thermosetting elastomer composition contacts the photoreceptor drum at the load of 2 to 60 N and the face pressure of 1.3 to 66.7 MPa when the photoreceptor drum is rotating, the cleaning blade contacts the peripheral surface of the photoreceptor drum at the contact width (nip width) of 3 to 10 μm.

The above-described nip width is set based on the finding that preferable cleaning performance can be obtained by setting the nip width thereof in the dynamic state in which the photoreceptor drum is rotating to a proper range.

As shown in FIG. 1, the contact state in the dynamic state is observed by observing the configuration of the edge of a cleaning blade 1 by using a high-speed camera 40 from a ridgeline direction with the cleaning blade 1 in contact with the columnar glass 30 and with the columnar glass 30 being rotated.

The columnar glass 30 is used as a substitution of the photoreceptor drum 12. The same transparent material as the material of the surface layer of the photoreceptor drum 12 is applied to the surface of the columnar glass 30.

The state of the contact of the cleaning blade with the photoreceptor drum (columnar glass) observed in the above-described manner is described below with reference to FIG. 2.

FIG. 2(A) shows the cleaning blade 1 before it is brought into contact with the photoreceptor drum. The cleaning blade 1 has a cut an edge portion 1*c* formed by two surfaces composed of a cut surface 1*a* precisely cut by a ridgeline cutter and a molded surface 1*b*, with about 90 degrees formed between the cut surface 1*a* and the molded surface 1*b*.

When the cleaning blade 1 is brought into contact with the photoreceptor drum 12 not rotating (static state), as shown in FIG. 2 (B), the cleaning blade 1 contacts the photoreceptor drum 12 at its molded surface 1*b* with the molded surface 1*b* having a comparatively large contact width (nip width). The nip width in this static state is set to nw1.

When the static state of FIG. 2 (B) is changed into a state (dynamic state) in which the photoreceptor drum 12 rotates in a direction shown with an arrow of FIG. 2(C), as shown in FIG. 2(C), a frictional force is generated between the cleaning blade 1 and the photoreceptor drum 12, and the edge portion 1*c* is dragged to have a deformation under stress. Therefore in the dynamic state, the cleaning blade 1 contacts the photoreceptor drum 12 at the cut surface 1*a* thereof with a contact width being much smaller than that in the static state. That is, supposing that the nip width in the dynamic state is nw2, nw2<nw1.

As described above, the cleaning blade 1 in the dynamic state causes friction and deforms under stress. Thus the contact state of the cleaning blade 1 in the dynamic state is greatly different from the contact state thereof in the static state.

Therefore to allow the cleaning blade to have a preferable cleaning performance when an image-forming apparatus is in operation, it is important to set the nip width in the dynamic state to a proper range.

In the present invention, the nip width of the cleaning blade at the time when the photoreceptor drum rotates is measured by a method described below to set the nip width of the cleaning blade in the dynamic state to 3 to 10 μm.

The nip width in the dynamic state is set to 3 to 10μ is for the reason described below. If the nip width of the cleaning blade at the time when the photoreceptor drum rotates is more than 10 μm, a contact area is large. As a result, a face pressure is low and there is a fear that defective cleaning is made. On the other hand, if the nip width of the cleaning blade at the time when the photoreceptor drum rotates is less than 3 μm, the contact area is small. As a result, the nip is unstable. Consequently there is a fear that the cleaning blade has a low wear resistance and defective cleaning is made. The nip width of the cleaning blade is set to more favorably 3 to 8 μm.

FIG. 3 shows the method of measuring the nip width of the cleaning blade when the photoreceptor drum rotates.

A cleaning member prepared by mounting a cleaning blade 1 on a supporting member (not shown) is installed on a measuring apparatus (not shown), produced by the present applicant, which has a function similar to that of an image-forming apparatus which has a photoreceptor drum and is capable of developing polymerized toner.

To observe and photograph the state of contact between the cleaning blade 1 and the photoreceptor drum from the inside of the photoreceptor drum, as shown in FIG. 3 (A), as a substitution of the photoreceptor drum, a transparent columnar glass 30, having a diameter of 30 mm, which accommodates a reflection mirror 31 is prepared. The same transparent material as a material applied to the surface of the photoreceptor drum is applied to the surface of the columnar glass 30.

Thereafter the cleaning blade 1 is brought into contact with the columnar glass 30 with a load being applied thereto.

A high-speed camera (FASTCAM-APX-RS-250K produced by Photron Inc.) 40 is set alongside the columnar glass 30. The columnar glass 30 is rotated at a linear speed of 200 mm/second to photograph the cleaning blade 1 reflected on the reflection mirror 31 mounted inside the columnar glass 30 at a photographing speed of 100,000 fps and an exposure time of 10 μs.

As shown in FIG. 3 (B), on an observed image 50, a portion of the cleaning blade 1 in contact with the columnar glass 30 appears as a shade 51. A width W3 of the shade 51 is measured, and the width W3 is converted by using a scale image measured separately to compute the nip width.

The nip width is found as an average value of eight static images selected at random from photographed images.

The test is conducted at a temperature of 23° C. and a relative humidity of 55%.

The load to be applied by the cleaning blade to the photoreceptor drum when the photoreceptor drum is rotating is set to 2 to 60 N is for the reason described below. If the load is more than 60 N, an excessively large pressure is set, which is unsuitable for the image-forming apparatus. If the load is less than 2 N, it is impossible to obtain a face pressure necessary for cleaning use. The load is set to favorably 2 to 40 N and more favorably 3 to 35 N.

The load is measured by using a pressure sensor.

The cleaning blade is in contact with the photoreceptor drum at a face pressure of 1.3 to 66.7 MPa is for the reason described below. If the face pressure is more than 66.7 MPa, the material composing the cleaning blade is incapable of withstanding the face pressure, and wear rapidly progresses. If the face pressure is less than 1.3 MPa, the pressure between the photoreceptor drum and the cleaning blade is so small that the cleaning blade is incapable of cleaning spherical polymerized toner having a small diameter. The cleaning blade is in contact with the photoreceptor drum at a face pressure of favorably 1.3 to 45 MPa and more favorably 1.3 to 40 MPa.

The face pressure is computed by using an equation shown below based on the above-described nip width and load.

Face pressure (MPa)=Load (N)/contact area ($mm^2$) of cleaning blade

Contact area ($mm^2$) of cleaning blade=nip width (mm)×length (mm) of ridgeline of cleaning blade It is preferable that the thermosetting elastomer composition molded into the cleaning blade has a hardness (JIS-A) of 60 to 90, a modulus of repulsion elasticity of 20 to 70%, a tensile strength of 10 to 80 MPa, and a tensile elongation of 100 to 600%.

The cleaning blade removes the toner from the surface of the photoreceptor drum by repeating the above-described static state and the dynamic state. The change rate of the nip width from the static state to the dynamic state is not constant, but depends greatly on the material of the cleaning blade. Therefore it is preferable to form the cleaning blade of the present invention of the thermosetting elastomer composition that has the above-described properties (hardness, modulus of repulsion elasticity, tensile strength, and tensile elongation).

The hardness (JIS-A) of the cleaning blade is set to 60 to 90 for the reason described below. If the hardness of the cleaning blade is more than 90, it has a low elasticity and a stable nip width cannot be obtained in the dynamic state. If the hardness of the cleaning blade is less than 60, the nip width is so large that the face pressure becomes low. Thereby defective cleaning is performed. The hardness of the cleaning blade is set to more favorably not less than 70 nor more than 85.

The hardness (JIS-A) of the cleaning blade of type A is measured in accordance with JIS K 6253 by using a prepared compressed ball.

The modulus of repulsion elasticity of the cleaning blade is set to 20 to 70% for the reason described below. If the modulus of repulsion elasticity of the cleaning blade is more than 70%, the cleaning blade sticks to the photoreceptor drum. Thus the cleaning blade does not shift smoothly from the static state to the dynamic state. More specifically, the cleaning blade has a large stick slip and bounds on the surface of the photoreceptor drum, which causes the toner to pass the cleaning blade without being cleaned thereby. Thus the cleaning blade has a low toner-removing performance. On the other hand, if the modulus of repulsion elasticity of the cleaning blade is less than 20%, the cleaning blade has a low elasticity and thus there is a fear that it has a low toner-removing performance. The modulus of repulsion elasticity of the cleaning blade is set to more favorably not less than 40% nor more than 60%.

By using a prepared compressed ball, the modulus of repulsion elasticity of the cleaning blade is measured at 23° C. in accordance with the LUPKE TYPE of JIS K 6255.

The tensile strength of the cleaning blade is set to 10 to 80 MPa for the reason described below. If the tensile strength of the cleaning blade is more than 80 MPa, the entire cleaning blade lacks rubber elasticity. If the tensile strength of the cleaning blade is less than 10 MPa, the cleaning blade is frail and liable to be worn, which is not preferable. The tensile strength of the cleaning blade is set to more favorably not less than 30 MPa nor more than 70 MPa and most favorably not more than 65 MPa.

To measure the tensile strength, a maximum strength of the dumbbell specimen No. 3 punched out of a sheet is measured when it is pulled at a pulling rate of 500 mm/minute in accordance with JIS K 6251.

The tensile elongation of the cleaning blade is set to 100 to 600% for the reason described below. If the tensile elongation of the cleaning blade is more than 600%, the cleaning blade elongates beyond a necessary extent and applies a weak load to the photoreceptor drum, thus having a low toner-removing performance. If the tensile elongation of the cleaning blade is less than 100%, the entire cleaning blade does not have rubber elasticity. The tensile elongation of the cleaning blade is set to more favorably not less than 200% nor more than 500%.

A dumbbell specimen No. 3 is punched out of a sheet to measure the elongation rate of the cleaning blades when the specimen is broken as a result of pulling at the pulling rate of 500 mm/minute in accordance with the tensile test of JIS K 6251.

The thermosetting elastomer composition is obtained by mixing the above-described components with one another by using a rubber kneading apparatus such as a single-axis extruder, a 1.5-axis extruder, a biaxial extruder, an open roll, a kneader, a Banbury mixer or a heated roller.

The order of mixing the components is not specifically limited, but it is possible to supply the components to the kneading apparatus all together. It is also possible to supply a part of the components to the kneading apparatus, knead them to obtain a mixture, add remaining components to the mixture, and re-perform a kneading operation. It is preferable to carry out a method of kneading the rubber component (1) and the filler (2) to obtain a mixture, adding the crosslinking agent (3) to the mixture, and thereafter re-performing a kneading operation.

By using a known molding method such as compression molding or injection molding, it is favorable to mold and process the thermosetting elastomer composition into the rectangular cleaning blade having a thickness of 1 to 3 mm, a length of 10 to 40 mm, and a width of 200 to 500 mm. The thickness is set to more favorably 1.5 to 2.5 mm and most favorably about 2 mm.

The cleaning blade formed from the thermosetting elastomer composition may have a single layer having the above-described configuration and a two-layer construction composed of a matrix layer and an edge layer.

In this case, the cleaning blade has an edge layer and a matrix layer, formed by molding the thermosetting elastomer composition, with a section thickness of the edge layer and that of the matrix layer being different from each other; the edge layer is fixed to one surface of the matrix layer to form a two-layer construction; and the edge layer is brought into contact with the photoreceptor drum.

The tensile permanent set of the matrix layer is set to 0 to 10%. The dynamic friction coefficient of the edge layer is set to 0.5 to 1.5.

Each of the matrix layer and the edge layer has a hardness (JIS-A) of 60 to 90, a modulus of repulsion elasticity of 20 to 70%, a tensile strength of 10 to 80 MPa, and a tensile elongation of 100 to 600%.

It is preferable to form the edge layer and the matrix layer of the cleaning blade from the thermosetting elastomer composition and it is preferable to mold and process the thermosetting elastomer composition into the rectangular cleaning blade having a thickness T of 1 to 3 mm, a length L of 10 to 40 mm, and a width W of 200 to 500 mm and thereafter cut a central portion of the cleaning blade to form a ridgeline.

The cleaning blade having the two-layer construction composed of the edge layer which is brought into contact with the photoreceptor drum and the matrix layer to which the edge layer is fixed has the shape of a flat rectangular solid. In mounting the cleaning blade on the image-forming apparatus, the cleaning blade is disposed therein by inclining it downward toward the photoreceptor drum with one side of the cleaning blade held in its longitudinal direction.

It is possible to dispose the edge layer and the matrix layer in the following two types (type A, type B).

In the type A, the matrix layer and the edge layer are constructed as a two-layer construction in a thickness T direction of the cleaning blade. A thickness t2 of the matrix layer is set larger than a thickness t1 of the edge layer, and a length L of the matrix layer is set same to that of the edge layer. The section thickness t1 of the edge layer, which becomes thickness direction of the cleaning blade, is set to 0.05 to 0.5 mm.

In the type B, the matrix layer and the edge layer are constructed as a two-layer construction in a length L direction of the cleaning blade. A thickness of the matrix layer is set same to that of the edge layer in a thickness T direction of the cleaning blade. The section length L1 of said edge layer, which becomes length direction of the cleaning blade, is set to 0.05 to 0.5 mm.

The type A has an advantage in processability that the edge layer and the matrix layer can be cut after they are bonded to each other. The type B has an advantage that the edge layer can be formed by using a small amount of a material.

In both types A and B, the section thickness of the edge layer is set to the range of 0.05 to 0.5 mm and preferably to the range of 0.05 to 0.3 mm.

Supposing that the thickness of the cleaning blade is set to a given value, the ratio of the edge layer to the matrix layer is large when the thickness of the edge layer is more than 0.5 mm. Thus it makes no sense to compose the cleaning blade of the two-layer construction. When the thickness of the edge layer is less than 0.05 mm, the edge layer is so thin that it is difficult to perform a molding operation.

The thickness t of the edge layer is found by measuring the thickness of the edge layer before it is bonded to the matrix layer by a dial gauge.

In the cleaning blade of the type A, the thickness t2 of the matrix layer is set to favorably 1.5 to 1.95 mm and more favorably 1.7 to 1.95 mm.

Supposing that the thickness T of the cleaning blade is set to a given value, the edge layer is thin when the thickness of the matrix layer is more than 1.95 mm. Thus it is difficult to perform a molding operation. When the thickness of the matrix layer is less than 1.5 mm, the ratio of the edge layer to the matrix layer is high. Thus it makes no sense to compose the cleaning blade of the two-layer construction.

On the other hand, in the cleaning blade of the type B, the length L2 of the matrix layer is set to favorably 11.9 to 12.35 mm and more favorably 12.1 to 12.35 mm.

Supposing that the length L of the cleaning blade is set to a given value, the edge layer is thin when the length of the matrix layer is more than 12.35 mm. Thus it is difficult to perform a molding operation. When the length of the matrix layer is less than 11.9 mm, the ratio of the edge layer to the matrix layer is large. Thus it makes no sense to compose the cleaning blade of the two-layer construction.

In both the cleaning blade having the single layer and the cleaning blade having the two-layer construction composed of the matrix layer and the edge layer, as described above, the thermosetting elastomer composition constructing the cleaning blade is composed of the rubber component (1), the filler (2), and the crosslinking agent (3).

As described above, the cleaning blade has the two-layer construction composed of the edge layer and the matrix layer, both having the above-described properties, which are combined with each other as desired so that the cleaning blade holds an optimum pressure and elasticity coping with an image-forming apparatus where the cleaning blade is mounted. Thereby with the edge of the cleaning blade keeping the contact with the surface of the photoreceptor drum at a high pressure, the cleaning blade follows fine irregularities of the surface of the photoreceptor drum and has an improved wear resistance.

Therefore in the cleaning blade of the present invention, the property of the edge layer and that of the matrix layer are differentiated from each other.

For example, the edge layer is formed of a high-hardness material having a hardness, a modulus of repulsion elasticity, a tensile strength, and a tensile elongation in the above-described range. The matrix layer is formed of a low-hardness material having a hardness, a modulus of repulsion elasticity, a tensile strength, and a tensile elongation in the above-described range.

Alternatively, the edge layer is formed of the low-hardness material having the hardness, the modulus of repulsion elasticity, the tensile strength, and the tensile elongation in the above-described range. The matrix layer is formed of the high hardness material having the hardness, the modulus of repulsion elasticity, the tensile strength, and the tensile elongation in the above-described range.

More specifically, the hardness of the edge layer is set to not less than 60 and less than 75. The modulus of repulsion elasticity of the edge layer is set to not less than 35% nor more than 70%. The hardness of the matrix layer is set to not less than 70 nor more than 90. The modulus of repulsion elasticity of the matrix layer is set to not less than 20% and less than 45%.

In the above-described construction, the edge layer which contacts the photoreceptor is elastic, whereas the matrix layer carries the pressure.

Alternatively the hardness of the edge layer is set to not less than 70 nor more than 90. The modulus of repulsion elasticity of the edge layer is set to not less than 20% and less than 45%. The hardness of the matrix layer is set to not less than 60 and less than 75. The modulus of repulsion elasticity of the matrix layer is set to not less than 35% nor more than 70%.

In the above-described construction, the entire cleaning blade has a high elasticity, and the edge layer which contacts the photoreceptor has a high hardness so that the edge layer maintains a necessary contact pressure.

As described above, by varying the property of the edge layer and that of the matrix layer from each other, namely, by forming the edge layer of the high-hardness material and the matrix layer of the low-hardness material or by forming the edge layer of the low-hardness material and the matrix layer of the high-hardness material and integrating the edge layer and the matrix layer with each other in such a way that the entire cleaning blade has a predetermined pressure and elasticity, the edge layer can be made of the low-hardness material or the high-hardness material in conformity to the characteristic the photoreceptor.

More specifically, in any of the combinations of matrix layer and the edge layer, the properties of the matrix layer and those of the edge layer are set to fall in the above-described range.

That is, the hardness (JIS-A) of the matrix layer is set to 60 to 90 and favorably 60 to 80. The hardness (JIS-A) of the matrix layer is set to the above-described range for the reason described below. If the hardness of the matrix layer is more than 90, the entire cleaning blade is not elastic and thus has a low tensile permanent set. If the hardness of the matrix layer is less than 60, the cleaning blade has a low linear pressure for the photoreceptor, which is not preferable.

On the other hand, the hardness (JIS-A) of the edge layer is set to 60 to 90 and favorably 60 to 80. The hardness (JIS-A) of the edge is set to the above-described range for the reason described below. If the hardness of the edge layer is more than 90, the edge layer is not elastic and thus the edge layer is incapable of following fine irregularities of the surface of the photoreceptor. If the hardness of the matrix layer is less than 60, there is a fear that the cleaning blade is turned over in the rotational direction of the photoreceptor.

The hardness (JIS-A) of each of sheets composing the matrix layer and the edge layer respectively is measured by using a compressed ball formed in accordance with JIS K 6253.

The modulus of repulsion elasticity of the matrix layer is set to 20 to 70% and favorably 30 to 70.

The modulus of repulsion elasticity of the matrix layer is set to the above-described range for the reason described below: If the modulus of repulsion elasticity of the matrix layer is more than 70%, owing to a frictional resistance between the cleaning blade and the photoreceptor, a phenomenon that the cleaning blade vibrates on the surface of the rotating photoreceptor occurs. That is, the entire cleaning blade generates "chatter". Thereby the cleaning blade has low performance of removing the toner on the photoreceptor. If the modulus of repulsion elasticity of the matrix layer is less than 20%, the cleaning blade lacks elasticity and there is a fear that the cleaning blade has a low toner-removing performance.

On the other hand, the modulus of repulsion elasticity of the edge layer is set to 20 to 70% and favorably 40 to 70. The modulus of repulsion elasticity of the edge layer is set to the above-described range for the reason described below. If the modulus of repulsion elasticity of the edge layer is more than 70%, the chatter is generated to a high extent. Thereby the cleaning blade has low performance of removing the toner on the photoreceptor. If the modulus of repulsion elasticity of the edge layer is less than 20%, the cleaning blade is not elastic and there is a fear that the cleaning blade is turned over in the rotational direction of the photoreceptor.

To measure the modulus of repulsion elasticity, the modulus of repulsion elasticity of each of sheets composing the matrix layer and the edge layer respectively is measured by using a prepared compressed ball in accordance with the LUPKE TYPE of JIS K 6255 at 23° C.

The tensile permanent set of the matrix layer is set to 0 to 10% and preferably not more than 8%. The tensile permanent set of the matrix layer is set to the above-described range for the reason described below. If the tensile permanent set of the matrix layer is more than 10%, the pressure to be applied by the cleaning blade to the photoreceptor is small when the cleaning blade is mounted in the image-forming apparatus for a long time. Thus the cleaning blade has defective toner-removing performance. Although the lower limit of the tensile permanent set is not limited to a specific value, it is preferable that the lower limit of the tensile permanent set is as close as zero.

A dumbbell specimen No. 4 is punched out of a sheet to measure the tensile permanent set of the matrix layer in accordance with JIS K 6262.

The tensile strength of the matrix layer and that of the edge layer are set to 10 to 80 MPa and favorably 30 to 70 MPa. The tensile strength of the matrix layer and that of the edge layer are set to the above-described range for the reason described below. If the tensile strength of the matrix layer and that of the edge layer are more than 80 MPa, the entire cleaning blade lacks rubber elasticity. If the tensile strength of the matrix layer is less than 10 MPa, the cleaning blade is frail and easily wears, which is not favorable.

To measure the tensile strength, a maximum strength of each of the dumbbell specimens No. 3 punched out of sheets composing the matrix layer and the edge layer respectively is measured when they are pulled at a pulling rate of 500 mm/minute in accordance with JIS K 6251.

The tensile elongation of the matrix layer and that of the edge layer are set to 100 to 600% and favorably 200 to 500%. The tensile elongation of the matrix layer and that of the edge layer are set to the above-described range for the reason described below. If the tensile elongation of the matrix layer and that of the edge layer are more than 600%, the matrix layer and the edge layer elongate beyond a necessary extent, and the cleaning blade applies a weak load to the photoreceptor. If the tensile elongation of the matrix layer and that of the edge layer are less than 100%, the entire cleaning blade do not have rubber elasticity, which is not preferable.

To measure the tensile elongation, the elongation rate of each of dumbbell specimens No. 3 punched out of sheets composing the matrix layer and the edge layer respectively is measured when the specimens were broken as a result of pulling at a pulling rate of 500 mm/minute in accordance with the tensile test of JIS K 6251.

The dynamic friction coefficient of the edge layer is set to 0.5 to 1.5 and favorably 0.5 to 1.3. The dynamic friction coefficient of the edge layer is set to the above-described range for the reason described below. If the dynamic friction coefficient of the edge layer is more than 1.5, a noise-making phenomenon and a chatter are generated and thus an inversion phenomenon is liable to occur. Further the edge layer has low toner-removing performance, which is not preferable. If the dynamic friction coefficient of the edge layer is less than 0.5, no frictional force is generated between the edge layer and the photoreceptor. As a result, the toner cannot be removed, which is not preferable.

The dynamic friction coefficient is computed from a sliding resistance of a cleaning blade to an OPC-applied glass (glass to which OPC (Organic Photo Conductor) produced by the present applicant is applied). To do so, after the cleaning blade having a length of 20 mm formed from a sheet having a thickness of 2 mm is bonded to a supporting member, the supporting member is mounted on a surface property measuring apparatus (type 14 produced by Shinto Kagaku Co., Ltd.) at an angle of 20 degrees, and thereafter the OPC-applied glass is moved at a load of 0.59 N and a moving speed of 100 mm/second by a counter method. The dynamic friction coefficient is obtained by measuring it five times and taking an average value of three values except maximum and minimum values.

As described above, the thermosetting elastomer composition essentially contains 5 to 60 parts by mass of zinc methacrylate (2*a*) or 5 to 60 parts by mass of a mixture (2*a*) of methacrylic acid and zinc oxide as the filler (2) for 100 parts by mass of the rubber component (1); or The thermosetting elastomer composition contains 10 to 75 parts by mass of a mixture (1*a*) of hydrogenated acrylonitrile-butadiene rubber serving as a base polymer thereof and the zinc methacrylate dispersed in the hydrogenated acrylonitrile-butadiene rubber in 100 parts by mass of the rubber component (1).

Thereby the co-crosslinking effect of the zinc methacrylate is displayed to improve the mechanical properties of the thermosetting elastomer composition so that the cleaning blade is provided with a predetermined face pressure and elasticity. Further an excessive reinforcing effect can be prevented from being generated to prevent the elastic function from being lost.

In using the zinc methacrylate or the mixture of the methacrylic acid and the zinc oxide as the filler (2), rubber component (1) includes acrylonitrile-butadiene rubber (NBR), acrylonitrile-butadiene rubber having a carbonyl group introduced thereinto, hydrogenated acrylonitrile-butadiene rubber (H-NBR), natural rubber (NR), butadiene rubber (BR), styrene-butadiene rubber (SBR), isoprene rubber (IR), butyl rubber (IIR), chloroprene rubber (CR), acrylic rubber (ACM, ANM), epichlorohydrin rubber (ECO), ethylene propylene rubber (EPR), ethylene-propylene-diene copolymer rubber (EPDM), and polyurethane rubber (U).

These rubber components may be used singly or by mixing two or more of them with each other.

As the rubber component (1), it is favorable to use the acrylonitrile-butadiene rubber (NBR) or/and the hydrogenated acrylonitrile-butadiene rubber (H-NBR). It is most favorable to use the hydrogenated acrylonitrile-butadiene rubber (H-NBR) having residual double bonds at not more than 10%.

As the NBR or NBR which is the material of the H-NBR, it is possible to use any of low-nitrile NBR having a bound acrylonitrile amount of not more than 25%, intermediate-nitrile NBR having the bound acrylonitrile amount of 25% to 31%, moderate high-nitrile NBR having the bound acrylonitrile amount of 31% to 36%, high-nitrile NBR having the bound acrylonitrile amount of not less than 36%. It is preferable that the bound acrylonitrile amount of the H-NBR which is used as a base polymer in which the zinc methacrylate is finely dispersed is favorably 17% to 50% and more favorably 21% to 46%.

As desired, other rubber may be combined with the acrylonitrile-butadiene rubber or/and the hydrogenated acrylonitrile-butadiene rubber. As the other rubber, any of the above-exemplified rubbers can be used. When the other rubber (rubber b) is combined with the acrylonitrile-butadiene rubber or/and the hydrogenated acrylonitrile-butadiene rubber (rubber a), the mixing amount of the rubber a with respect to the sum of the rubber component (1), namely, 100 parts by mass is favorably 90 parts by mass to 50 parts by mass and more favorably 90 parts by mass to 70 parts by mass, and the mixing amount of the rubber b for 100 parts by mass of the rubber component (1) is favorably 10 parts by mass to 50 parts by mass and more favorably 10 parts by mass to 30 parts by mass.

As the filler (2), the zinc methacrylate (2*a*) or the mixture (2*a*) of the methacrylic acid and the zinc oxide is used. As described above, the mixing amount of the zinc methacrylate (2*a*) or that of the mixture (2*a*) of the methacrylic acid and the zinc oxide is set to 5 parts by mass to 60 parts by mass for 100 parts by mass of the rubber component (1).

It is preferable to use one or more kinds of additives selected from the group of fillers (2*b*) including a co-crosslinking agent, a vulcanization accelerator, a vulcanization-accelerating assistant, an age resistor, a softener for rubber, a reinforcing agent, and other kinds of additives. It is preferable to mix 0.1 to 80 parts by mass of the filler (2*b*) for 100 parts by mass of the rubber component (1). It is more preferable to mix 0.1 to 20 parts by mass of the filler (2*b*) for 100 parts by mass of the rubber component (1).

In using the mixture of the hydrogenated acrylonitrile-butadiene rubber (H-NBR) serving as the base polymer and the zinc methacrylate very finely dispersed therein as the rubber component (1), the zinc methacrylate may be mixed into the H-NBR and finely dispersed therein or the methacrylic acid and the zinc oxide may be mixed into the H-NBR and the zinc methacrylate generated by the mixing may be finely dispersed in the H-NBR.

In the H-NBR in which the zinc methacrylate is finely dispersed, the zinc methacrylate is added to the H-NBR at favorably 40 to 240 parts by mass, more favorably at 80 to 120 parts by mass, and most favorably at 91 to 115 parts by mass for 100 parts by mass of the H-NBR.

As the H-NBR in which the zinc methacrylate is finely dispersed to a high extent, it is possible to use a commercially available product in which the zinc methacrylate is mixed with the H-NBR in advance. For example, "Zeoforte ZSC series" produced by Zeon Corporation can be used.

In this case, the H-NBR (1*a*), serving as the base polymer, in which the zinc methacrylate is dispersed is used at 10 to 75 parts by mass in 100 parts by mass of the rubber component (1).

The co-crosslinking agent of the filler (2) crosslinks itself and reacts with rubber molecules to crosslink them, thus making the entire elastomer composition polymeric.

As the co-crosslinking agent, it is possible to use ethylene unsaturated monomers, polyfunctional polymers, and dioximes.

As the ethylene unsaturated monomer that can be preferably used as the co-crosslinking agent in the present invention, the following substances are listed:

methacrylic acid;

ester of methacrylic acid such as trimethylolpropane trimethacrylate (TMPT), ethylene dimethacrylate (EDMA), polyethylene glycol dimethacrylate, cyclohexyl methacrylate, allyl methacrylate, tetrahydrofurfuryl methacrylate, and isobutylene ethylene dimethacrylate;

metal salts of methacrylic acid or acrylic acid such as aluminum acrylate, aluminum methacrylate, zinc acrylate, zinc methacrylate, calcium acrylate, calcium methacrylate, magnesium acrylate, magnesium methacrylate, and the like; and triallyl isocyanurate, triallyl cyanurate, diallyl phthalate, diallyl itaconate, vinyl toluene, vinyl pyridine, and divinylbenzene.

As the polyfunctional polymers, those utilizing the functional group of 1,2-polybutadiene are listed. More specifically, Buton 150, Buton 100, polybutadiene R-15, Diene-35, Hystal-B2000, and the like are listed.

As the above-described dioximes, p-quinonedioxime, p,p'-dibenzoyl quinonedioxime, N,N'-m-phenylenebismaleimide, and the like are listed.

Of the above-described co-crosslinking agents, the zinc methacrylate is used as the main co-crosslinking agent. But other co-crosslinking agents may be used in combination with the zinc methacrylate as necessary.

As the vulcanization accelerator, both inorganic and organic accelerators can be used.

As the inorganic accelerator, it is possible to use slaked lime, magnesium oxide, titanium oxide, and litharge (PbO).

As the organic accelerator, thiurams, thiazoles, thioureas, dithiocarbamates, guanidines, and sulfeneamides are listed.

As the thiurams, tetramethylthiuram monosulfide, tetramethylthiuram disulfide, tetraethylthiuram disulfide, tetrabutylthiuram disulfide, and dipentamethylenethiuram tetrasulfide are listed.

As the thiazoles, it is possible to list 2-mercaptobenzothiazole, dibenzothiazyl disulfide, N-cyclohexyl benzothiazole, N-cyclohexyl-2-benzothiazolesulfeneamide, N-oxydiethylene-2-benzothiazolesulfeneamide, N-tert-butyl-2-benzothiazolesulfeneamide, and N,N-dicyclohexyl-2-benzothiazolesulfeneamide.

As the thioureas, N,N'-diethylthiourea, ethylenethiourea, and trimethylthiourea are listed.

As the salts of the dithiocarbamates, zinc dimethyl dithiocarbamate, zinc diethyl dithiocarbamate, zinc dibutyl dithiocarbamate, sodium dimethyl dithiocarbamate, sodium diethyl dithiocarbamate, copper dimethyl dithiocarbamate, ferric dimethyl dithiocarbamate (III), selenium diethyl dithiocarbamate, and tellurium diethyl dithiocarbamate are listed.

As the guanidine accelerator, it is possible to list di-o-tolyl guanidine, 1,3-diphenyl guanidine, 1-o-tolylbiguanide, and di-o-tolylbiguanide salts of dicatechol borate.

As the sulfeneamides, N-cyclohexyl-2-benzothiazole sulfeneamide and the like are listed.

The mixing amount of the vulcanization accelerator should be large enough to allow the property of the rubber component to be sufficiently displayed. In the present invention, the mixing amount of the vulcanization accelerator is selected in the range of 0 to 3 parts by mass for 100 parts by mass of the rubber component.

The vulcanization-accelerating assistant that is used in the present invention includes metal oxides such as zinc white, zinc carbonate, and the like; fatty acids such as stearic acid, oleic acid, cotton seed fatty acid; and known vulcanization-accelerating assistants. The metal oxides such as zinc white also serve as reinforcing agents described below.

The mixing amount of the vulcanization-accelerating assistant should be large enough to allow the property of the rubber component to be sufficiently displayed. In the present invention, the mixing amount of the vulcanization accelerator is selected in the range of 0 to 30 parts by mass and favorably 0.5 to 5 parts by mass for 100 parts by mass of the rubber component.

In the present invention, the mixture of the zinc oxide and the methacrylic acid is mixed with the rubber component (1) to thereby form the zinc methacrylate in the rubber so that the co-crosslinking effect of the zinc methacrylate is displayed. In the present invention, the zinc oxide used together with the methacrylic acid to form the zinc methacrylate is included in the co-crosslinking agent not in the vulcanization-accelerating assistant.

As the plasticizer, compounds of phthalic acid, adipic acid, sebacic acid, benzoic acid, and the like. More specifically, dibutyl phthalate (DBP), dioctyl phthalate (DOP), tricresyl phosphate (TCP), and the like are listed.

The age resistor means a compounding ingredient for preventing deterioration such as oxidative deterioration, heat deterioration, ozone deterioration, and fatigue deterioration. The age resistor is classified into a primary age resistor consisting of amines and phenols; and a secondary age resistor consisting of sulfur-containing compounds and phosphites. The primary age resistor has a function of giving hydrogen to various polymer radicals and stopping a chain reaction of automatic oxidation. The secondary age resistor shows a stabilizing action by changing hydroxy peroxide into a stable alcohol.

In recent years, the cleaning blade for use in the image-forming apparatus is subjected to various environments. Therefore it is necessary to take measures for preventing the cleaning blade from aging. A polymer is destroyed by the friction between a photoreceptor and the cleaning blade. A radical generated by the destruction of the polymer accelerates an automatic oxidative reaction. Oxidative deterioration accelerates wear of the cleaning blade. Therefore it is necessary to take measures for preventing the oxidative deterioration of the cleaning blade. Because the cleaning blade is subjected to high-temperature environment, it is important to take measures for preventing thermal deterioration of the cleaning blade. Further, because ozone is generated by a charging mechanism, it is important to take measures for preventing ozone-caused deterioration of the cleaning blade. Therefore it is possible to prevent the above-described oxidative deterioration, heat deterioration, ozone deterioration, and fatigue deterioration in combination of several kinds of age resistors. It is particularly important to mix the age resistor for preventing the wear of the edge of the cleaning blade caused by the oxidative deterioration.

As the age resistor, amines, phenols, imidazoles, and phosphorus-containing substances, and thioureas are listed.

As the amines, phenyl-α-naphthylamine, 2,2,4-trimethyl-1,2-dihydroquinoline polymer (TMDQ), 6-ethoxy-2,2,4-trimethyl-1,2-dihydroquinoline (ETMDQ), p,p'-dioctyldiphenylamine (ODPA), p,p'-dicumyldiphenylamine (DCDP), N,N'-di-2-naphthyl-p-phenylenediamine (DNPD), N,N'-diphenyl-p-phenylenediamine (DPPD), N-phenyl-N'-isopropyl-p-phenylenediamine (IPPD), and N-phenyl-N'-1,3-dimethylbutyl-p-phenylenediamine (6PPD) are listed.

The phenols that are used in the present invention includes 2,6-di-tert-butyl-4-methyl phenol (BHT); 2,6-di-tert-butyl-4-methyl phenol (DTBMP); styrenated methyl phenol; 2,2'-methylene bis(4-ethyl-6-tert-butyl phenol); 2,2'-methylene bis(4-methyl-6-tert-butyl phenol) (MBMBP); 4,4'-butylidene bis(3-methyl-6-tert-butyl phenol) (BBMTBP); 4,4'-thiobis (3-methyl-6-tert-butyl phenol) (TBMTBP); 2,5-di-tert-butyl hydroquinone (DBHQ); and 2,5-di-tert-amyl hydroquinone (DAHQ).

As the imidazoles, 2-mercaptobenzimidazole (MBI), zinc salts of 2-mercaptobenzimidazole (ZnMBI), and nickel dibutyldithiocarbamate (NiBDC) are listed.

As other age resistors, it is possible to use phosphorus-containing substances such as tris (nonyl phenyl) phosphite (TNPP); thioureas such as 1,3-bis (dimethylaminopropyl)-2-thiourea, tributyl thiourea (TBTU), and the like; and wax for preventing ozone-caused deterioration.

The p,p'-dicumyldiphenylamine and the 2-mercaptobenzimidazole can be preferably used.

It is favorable that the mixing amount of the age resistor is set to 0.1 to 15 parts by mass for 100 parts by mass of the rubber component (1). The reason the mixing amount of the age resistor is set to 0.1 to 15 parts by mass for 100 parts by mass of the rubber component (1) is as follows: When the mixing amount of the age resistor is less than 0.1 parts by mass, the effect of the age resistor is not displayed. Thus there is a fear that the resulting thermosetting elastomer composition has an inferior mechanical property and an excessive wear. On the other hand, when the mixing amount of the age resistor exceeds 15 parts by mass, the age resistor is dispersed unfavorably owing to an excessive mixing amount thereof. Thereby there is a fear that the thermosetting elastomer composition has an inferior mechanical property.

It is more favorable that the mixing amount of the age resistor is set to 0.5 to 10 parts by mass for 100 parts by mass of the rubber component.

As the softener for rubber, it is possible to use derivatives of phthalic acid, isophthalic acid, adipic acid, sebacic acid, benzoic acid, and phosphoric acid. The mixing amount of the softener for rubber should be large enough to allow the property of the rubber component to be sufficiently displayed. The mixing amount of the softener for rubber is selected in the range of 0 to 5 parts by mass for 100 parts by mass of the rubber component.

As the reinforcing agent, in addition to carbon black mainly used as a filler for guiding an interaction of the carbon black with the elastomer, it is possible to use inorganic reinforcing agents such as white carbon (silica filler such as dry silica or wet silica, silicate such as magnesium silicate), calcium carbonate, magnesium carbonate, magnesium silicate, clay (aluminum silicate), silane-modified clay, and talc; and organic reinforcing agents such as coumarone and indene resin, phenol resin, high styrene resin, and wood meal.

As the carbon black, it is preferable to use SAF carbon (average particle diameter: 18 to 22 μm), ISAF carbon (average particle diameter: 19 to 29 μm), HAF carbon (average particle diameter: about 26 to 30 μm), and FEF carbon (average particle diameter: about 40 to 52 μm) are listed.

The ISAF carbon (average particle diameter: 19 to 29 μm) can be preferably used because it is superior in its reinforcing effect, low in its cost and excellent in its dispersibility and wear resistance.

In the present invention, because the mechanical property of the thermosetting elastomer composition can be improved to a high extent owing to the co-crosslinking effect of the zinc methacrylate, the thermosetting elastomer composition does not necessarily have to contain the above-described reinforcing agent therein. But as desired, 0 to 100 parts by mass of the reinforcing agent can be mixed with 100 parts by mass of the rubber component.

As other additives, amide compounds, metal salts of fatty acids, and wax are listed.

As the amide compounds, aliphatic amide compounds and aromatic amide compounds are listed. As fatty acids of the aliphatic amide compounds, oleic acid, stearic acid, erucic acid, caproic acid, caprilic acid, capric acid, lauryl acid, myristic acid, palmitic acid, arachidic acid, behenic acid, palmitoleic acid, eicosane acid, erucic acid, elaidic acid, trans-11-eicosane acid, trans-13-docosane acid, linolic acid, linolenic acid, and ricinoleic acid are listed. As the aliphatic amide compounds, it is preferable to use ethylene-bis-erucamide, ethylene-bis-oleamide, ethylene-bis-stearamide, oleamide, stearamide, erucamide, and behenamide. The oleamide, the stearamide, and the erucamide are especially preferable.

As the metal salts of the fatty acids, the fatty acids include lauryl acid, stearic acid, palmitic acid, myristic acid, and oleic acid are listed. The metals include zinc, iron, calcium, aluminum, lithium, magnesium, strontium, barium, cerium, titanium, zirconium, lead, and manganese.

As the wax, paraffin wax, montan wax, amide wax are listed.

The mixing amount of these additives should be large enough to allow the property of the rubber component to be sufficiently displayed. In the present invention, the mixing amount of the additives for 100 parts by mass of the rubber component is selected in the range of 0 to 10 parts by mass as desired.

It is preferable that the thermosetting elastomer composition composing the cleaning blade of the present invention contains 0.1 to 30 parts by mass of the crosslinking agent (3). The mixing amount of the crosslinking agent (3) is set to 0.1 to 30 for the reason described below. If the mixing amount of the crosslinking agent (3) is less than 0.1 parts by mass, the vulcanizing density is low. Thus there is a fear that a desired property cannot be obtained. On the other hand, the mixing amount of the crosslinking agent (3) is more than 30 parts by mass, the thermosetting elastomer composition has an excessively high hardness owing to an excessive crosslinking reaction. Thus there is a fear that the cleaning blade of the present invention damages the photoreceptor drum.

As the crosslinking agent (3), organic peroxide, sulfur, organic sulfur-containing compound, heat-resistant crosslinking agent, and resin crosslinking agent are used.

Powder sulfur is used as the sulfur.

As the organic sulfur-containing compounds, N,N'-dithiobismorpholine, diphenyl disulfide, pentabromodisulfide, pentachlorothiophenol, and zinc pentachlorothiophenolate, and the like are listed.

As the organic peroxides, it is possible to list dicumyl peroxide, benzoyl peroxide, 1,1-di-(tert-butyl peroxy)-3,3,5-trimethylcyclohexane, 2,5-dimethyl-2,5-di-(benzoyl peroxy)

hexane, 2,5-dimethyl-2,5-di-(benzoyl peroxy)-3-hexene, 2,5-dimethyl-2,5-di-(tert-butyl peroxy)hexane, di-tert-butyl peroxy-di-isopropylbenzene, di-tert-butyl peroxide, di-tert-butylperoxybenzoate, dicumyl peroxide, tert-butyl cumyl peroxide, 2,5-dimethyl-2,5-di-(tert-butyl peroxy)-3-hexene, 1,3-bis(tert-butyl peroxyisopropyl)benzene, n-butyl-4,4-bis (tert-butyl peroxy)valerate, p-chlorobenzoyl peroxide, 2,4-dichlorobenzoyl peroxide, tert-butyl peroxyisopropyl carbonate, diacetyl peroxide, and lauroyl peroxide. Above all, the dicumyl peroxide can be preferably used.

As the heat-resistant crosslinking agent, 1,3-bis(citraconimide methyl)benzene, hexamethylene-1,6-sodium bisthiosulfate-dihydrate, and 1,6-bis(dibenzylthiocarbamoyl disulfide)hexane are listed.

As the resin crosslinking agent, alkylphenol resin or bromized alkylphenol formaldehyde resin such as Tackyroll 201 (produced by Taoka Kagaku Kogyo Inc.), Tackyroll 250-III (produced by Taoka Kagaku Kogyo Inc.), and Hitanol 2501 (produced by Hitachi Kasei Kogyo Inc.) are listed.

The crosslinking agent can be used singly or in combination of two or more kinds. The mixing amount of the crosslinking agent should be large enough to allow the property of the rubber component to be sufficiently displayed. In the present invention, the mixing amount of the crosslinking agent is selected normally in the range of 0.1 to 30 parts by mass for 100 parts by mass of the rubber component (1).

As described above, when the photoreceptor drum is rotating, the cleaning blade of the present invention contacts the peripheral surface of the photoreceptor drum in a proper nip width. Thus it is possible to securely improve the performance of the cleaning blade in removing the toner remaining on the surface of the photoreceptor drum. The cleaning blade of the present invention is excellent in the performance of cleaning the spherical polymerized toner having a small diameter.

In combining the edge layer and the matrix layer with each other to form the two-layer construction, the matrix layer is selected according to whether emphasis is laid on the elasticity or the pressure to be applied to the edge layer so that owing to the combination of the edge layer and the matrix layer, it is possible to impart elasticity to the cleaning blade to such an extent that the cleaning blade is capable of following the fine irregularities of the surface of the photoreceptor and increase the linear pressure to the photoreceptor and provide the cleaning blade with an excellent wear resistance for a long time.

DETAILED DESCRIPTION OF THE PREFERRED EMBODIMENTS

The embodiment of the cleaning blade of the present invention for use in an image-forming apparatus will be described in detail below with reference to the drawings.

Figure 4:
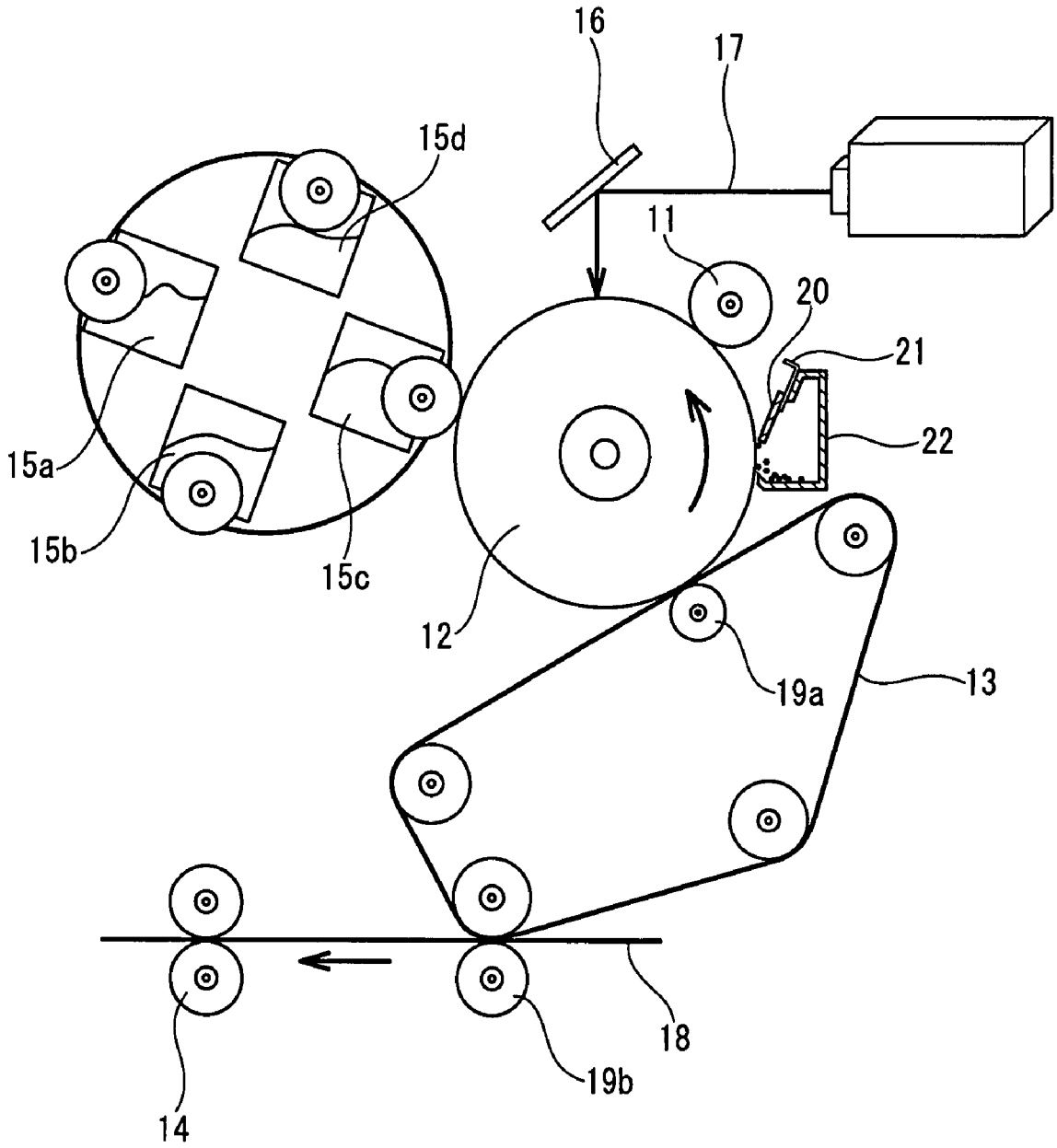
FIG. 4 is an illustrative view showing a color image-forming apparatus on which the cleaning blade of the present invention is mounted.

FIG. 4 shows a cleaning blade 20 and an image-forming apparatus in which the cleaning blade 20 is mounted.

Normally, the cleaning blade 20 is bonded to a supporting member 21 with an adhesive agent. The supporting member 21 is composed of a rigid metal, an elastic metal, plastic or ceramic. It is favorable that the supporting member 21 is made of metal and more favorable that it is made of chrome free SECC.

As the adhesive agent for bonding the cleaning blade 20 and the supporting member 21 to each other, a polyamide or polyurethane hot-melt adhesive agent and an epoxy or phenol adhesive agent are used. It is preferable to use the hot-melt adhesive agent.

The color image-forming apparatus shown in FIG. 4 forms an image in processes described below:

Initially, a photoreceptor drum 12 rotates in the direction shown with the arrow of FIG. 4. After the photoreceptor drum 12 is charged by a charging roller 11, a laser 17 exposes a non-imaging portion of the photoreceptor drum 12 via a mirror 16, thus destaticizing the non-imaging portion. At this time, the portion of the photoreceptor drum 12 corresponding to an imaging portion is charged. Thereafter a toner 15*a* is supplied to the photoreceptor drum 12 and attaches to the charged imaging portion to form a first-color toner image. The toner image is transferred to an intermediate transfer belt 13 via a primary transfer roller 19*a*. In the same manner, a toner image of each of other color toners 15*b* to 15*d* formed on the photoreceptor drum 12 is transferred to the intermediate transfer belt 13. A full-color image composed of the four color toners 15*a* through 15*d* is formed on the intermediate transfer belt 13. The full-color image is transferred to a to-be-transferred material (normally, paper) 18 via a secondary transfer roller 19*b*. When the to-be-transferred material 18 passes between a pair of a fixing rollers 14 heated to a predetermined temperature, the full-color image is fixed to the surface thereof.

In the above-described processes, to sequentially copy the image of an original document on a plurality of recording paper, toner which has not been transferred to the intermediate transfer belt 13 but remains on the photoreceptor drum 12 is removed from the surface of the photoreceptor drum 12 by rubbing the photoreceptor drum 12 with a cleaning blade 20 pressed against the surface of the photoreceptor drum 12 and is collected in a toner collection box 22.

The cleaning blade 20 of the first embodiment is composed of one member of a single layer.

Figure 5:
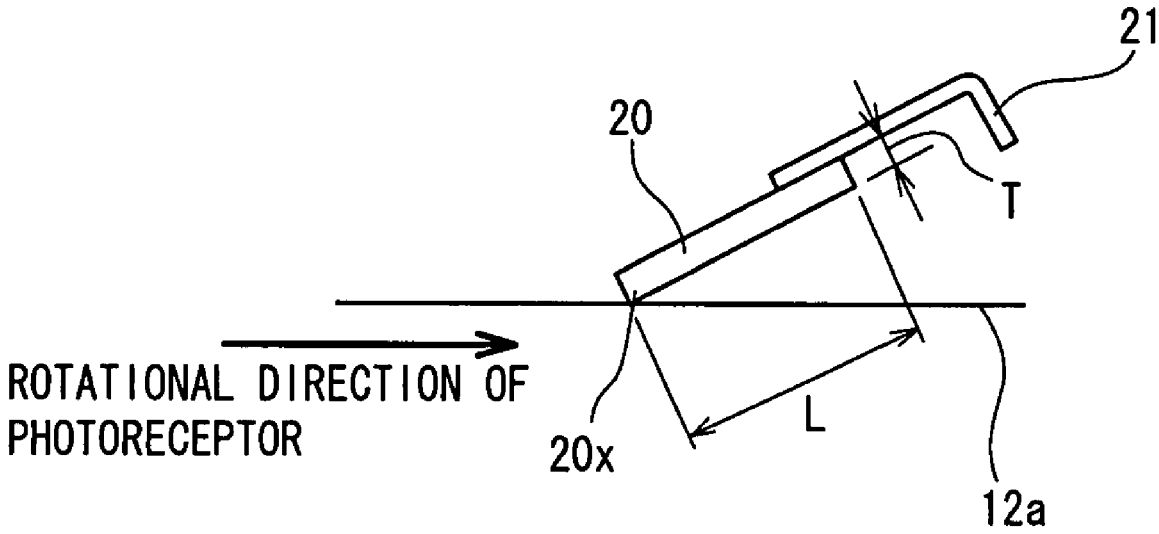
FIG. 5 is an explanatory view for explaining a state in which the cleaning blade contacts the photoreceptor drum.

As shown in FIG. 5, an edge 20*x* of the cleaning blade 20 is brought into contact with a peripheral surface 12*a* of a photoreceptor drum 12 at a nip width of 3 to 10 μm in a dynamic state when the nip width is measured by using a method described later in the examples of the present invention.

More specifically, the cleaning blade 20 is pressed against the rotating photoreceptor drum 12 at a load of 2 to 60 N and preferably at 2 to 40 N. With cleaning blade 20 in contact with the photoreceptor drum 12 at a face pressure of 1.3 to 66.7 MPa and favorably 1.3 to 45 MPa, the nip width of the cleaning blade 20 is set to 3 to 10 μm.

As described above, by bringing the cleaning blade 20 into contact with the photoreceptor drum 12 at a small load and at a high face pressure and setting the nip width to 3 to 10 μm, conditions suitable for toner removal are obtained. Thereby the cleaning blade 20 has a favorable performance of removing spherical polymerized toner having a small diameter.

The load and the face pressure are measured by using a method described in the examples described later.

The cleaning blade 20 of the first embodiment is formed by molding a thermosetting elastomer composition.

The thermosetting elastomer composition essentially contains a rubber component (1), a filler (2*a*, 2*b*), and a crosslinking agent (3).

As the rubber component (1), acrylonitrile-butadiene rubber (1*a*) or/and a hydrogenated acrylonitrile-butadiene rubber (1*a*) are used.

As the acrylonitrile-butadiene rubber, it is preferable to use moderate high-nitrile acrylonitrile-butadiene rubber having a bound acrylonitrile amount of 31% to 36%.

As the hydrogenated acrylonitrile-butadiene rubber, it is preferable to hydrogenate the moderate high-nitrile acrylonitrile-butadiene rubber to allow the hydrogenated acrylonitrile-butadiene rubber to have a residual double bond of not more than 10%. It is most favorable to use the hydrogenated acrylonitrile-butadiene rubber having the residual double bond of not more than 10% as the rubber component (1).

As the filler (2), a mixture (2*a*) of the methacrylic acid serving as a co-crosslinking agent and zinc oxide serving as a vulcanization-accelerating assistant is added to the rubber component (1). The mixing ratio between the methacrylic acid and the zinc oxide is set to approximately 1:1. The mixing amount of the mixture of the methacrylic acid and the zinc oxide is set to 5 to 60 parts by mass for 100 parts by mass of the rubber component (1).

As the co-crosslinking agent which is used as the filler (2), the zinc methacrylate (2*a*) can be added to the rubber component (1). The mixing amount of the zinc methacrylate is set to 5 parts by mass to 60 parts by mass for 100 parts by mass of the rubber component (1).

Instead of adding the zinc methacrylate or the mixture of the methacrylic acid and the zinc oxide to the rubber component (1), a mixture (1*a*) of the H-NBR serving as the base polymer and the zinc methacrylate finely dispersed therein can be added to the rubber component (1). That is, as the rubber component (1), the NBR or/and the H-NBR (rubber a) is used and 10 to 75 parts by mass of 100 parts by mass of the rubber component (1) consists of the mixture (1*a*) of the H-NBR serving as the base polymer and the zinc methacrylate finely dispersed therein.

The amount of the zinc methacrylate which is dispersed in the H-NBR serving as the base polymer is 91 parts by mass to 110 parts by mass for 100 parts by mass of the H-NBR.

The bound acrylonitrile amount of the H-NBR serving as the base polymer is set to 21% to 44%. The Mooney viscosity ML1+4 of the H-NBR at 100° C. is set to 40 to 150.

As other fillers (2*b*), a vulcanization accelerator, a vulcanization-accelerating assistant, a reinforcing agent, and an age resistor are added to the rubber component (1).

As the vulcanization accelerator, magnesium oxide which is an inorganic accelerator, and dibenzothiazyl sulfide and tetramethylthiuram monosulfide which are organic accelerators are used. The mixing amount of the vulcanization accelerator is set to 0 to 3 parts by mass for 100 parts by mass of the rubber component (1).

As the vulcanization-accelerating assistant, in addition to the zinc oxide, stearic acid is used. The mixing amount of the stearic acid is set to 0 to 5 parts by mass for 100 parts by mass of the rubber component (1).

As the reinforcing agent, carbon black is used. The mixing amount of the reinforcing agent is set to 0 to 100 parts by mass for 100 parts by mass of the rubber component (1).

As the age resistor, p,p'-dicumyldiphenylamine and 2-mercaptobenzimidazole are used. The mixing amount of the age resistor is set to 0.1 to 15 parts by mass for 100 parts by mass of the rubber component.

As the crosslinking agent (3), sulfur, sulfur-containing compounds, and organic peroxides are used. These crosslinking agents may be used singly or by mixing two or more of them with each other.

As the sulfur, powder sulfur is used. The mixing amount of the sulfur is set to 0 to 30 parts by mass for 100 parts by mass of the rubber component (1).

As the sulfur compound, diphenyl disulfide is used. The mixing amount of the sulfur compound is set to 0.1 to 20 parts by mass for 100 parts by mass of the rubber component (1).

As the organic peroxide, it is preferable to use dicumyl peroxide. The mixing amount of the organic peroxide for 100 parts by mass of the rubber component (1) is set to 0.5 to 10 parts by mass and preferably 1 to 6 parts by mass.

The mixing amount of the crosslinking agent (3) composed of the sulfur, the sulfur-containing compound, and the organic peroxide is set to 0.5 to 30 parts by mass for 100 parts by mass of the rubber component (1).

The thermosetting elastomer composition which is used in the present invention is produced as described below:

Initially the rubber component (1) and the filler (2) are kneaded at 80 to 120° C. for five to six minutes with the kneading apparatus such as the single-axis extruder, the 1.5-axis extruder, the biaxial extruder, the open roll, the kneader, the Banbury mixer, and the heated roller. If the kneading temperature is less than 80° C. and the kneading period of time is less than five minutes, the rubber component (1) is insufficiently plasticized and the mixture is insufficiently kneaded. If the kneading temperature is more than 120° C. and the kneading period of time is more than six minutes, there is a fear that the rubber component (1) is decomposed.

After the crosslinking agent (3) is added to the obtained mixture, they are kneaded at 80 to 90° C. for five to six minutes by using the above-described kneading apparatuses. If the kneading temperature is less than 80° C. and the kneading period of time is less than five minutes, the mixture is insufficiently plasticized and kneaded. If the kneading temperature is more than 90° C. and the kneading period of time is more than six minutes, there is a fear that the crosslinking agent (3) is decomposed.

The cleaning blade 20 of the present invention is formed by molding the thermosetting elastomer composition obtained by carrying out the above-described method. It is preferable to mold and process the thermosetting elastomer composition into the rectangular cleaning blade 20 having a thickness T of 1 to 3 mm, a length L of 10 to 40 mm, and a width W of 200 to 500 mm.

The molding method is not specifically limited but a known method such as the injection molding or the compression molding can be used.

More specifically, press vulcanization is performed at 160° C. to 170° C. for 20 to 40 minutes, with the thermosetting elastomer composition set in a die. If the vulcanizing temperature is less than 160° C. and the vulcanizing period of time is less than 20 minutes, the thermosetting elastomer composition is not sufficiently vulcanized. If the vulcanizing temperature is more than 170° C. and the vulcanizing period of time is more than 40 minutes, there is a fear that the rubber component is decomposed.

In addition, when polyurethane rubber is used as the rubber component (1), a polyurethane rubber sheet may be formed as described below.

Initially isocyanate (R—N═C═O) which is a base agent and polyether polyol or polyester polyol which is a hardening agent are mixed with each other to form a prepolymer. Thereafter a crosslinking agent is mixed with the prepolymer at 70° C. to form liquid polyurethane (unhardened polyurethane composition, namely, thermosetting elastomer composition). Thereafter the unhardened polyurethane composition is injected to a sheet-molding die, heated at 140 to 150° C. for 20 to 40 minutes, and hardened to form a sheet. It is possible to use polyurethane rubber sheet commercially available.

The cleaning blade 20 obtained by carrying out the above-described method has the following properties: hardness (JIS-A) of 60 to 90, a modulus of repulsion elasticity of 20 to 70%, a tensile strength of 10 to 80 MPa, and a tensile elongation of 100 to 600%. Because the cleaning blade 20 has the above-described properties, the cleaning blade 20 is excellent in its wear resistance and in the performance of cleaning spherical polymerized toner having a small diameter.

The above-described properties are measured by a method in the examples of the present invention described below.

When the cleaning blade 20 is brought into contact with the photoreceptor drum 12 by applying a load to the photoreceptor drum 12, the cleaning blade 20 has the above-described nip width when the photoreceptor drum 12 is rotating. Therefore the cleaning blade 20 does not generate a noise-making phenomenon nor the inversion phenomenon and is excellent it its wear resistance and cleaning performance.

Examples 1 through 6 of the first embodiment of the present invention and comparison examples 1 through 3 are described below.

EXAMPLES 1 THROUGH 6 AND COMPARISON EXAMPLES 1 THROUGH 3

After the mixing amount of each of the rubber component (1) and the filler (2*a*, 2*b*) shown in tables 1 (A) through 1 (D) was measured, the rubber component (1) and the filler (2*a*, 2*b*) were supplied to a rubber kneading apparatus such as a biaxial extruder, an open roll, Banbury mixer or a kneader. Thereafter they were kneaded for five to six minutes while they were being heated at 80° C. to 120° C.

The obtained mixture and the crosslinking agent (3), the mixing amount of which is shown in table 1 were supplied to the rubber kneading apparatus such as the open roll, the Banbury mixer or the kneader. Thereafter they were kneaded for five to six minutes while they were being heated to 80° C. to 90° C.

After the obtained rubber composition was set in a die, it was press-vulcanized at 160° C. to 170° C. for 20 to 40 minutes to obtain a sheet having a thickness of 2 mm.

TABLE 1

| | | THERMOSETTING ELASTOMER COMPOSITION | | | |
|---|---|---|---|---|---|
| | | A CE 1, 2 | B E 1~3 | C E 4~6 | D CE 3 |
| RUBBER COMPONENT (1) | NBR | 100 | | 100 | 100 |
| | H-NBR | | 45 | | |
| | ZDMA-CONTAINING H-NBR (1a) | | 55 | | |
| FILLER (2a) | METHACRYLIC ACID | 5 | | 10 | 5 |
| | ZINC OXIDE | 5 | | 10 | 5 |
| FILLER (2b) | CARBON BLACK | 60 | | 15 | 1 |
| | AGE RESISTOR A | | 1 | 1 | |
| | AGE RESISTOR B | | 2 | 2 | |
| CROSSLINKING AGENT (3) | SULFUR-CONTAINING COMPOUND | | 1.5 | | |
| | ORGANIC PEROXIDE | 1 | 4 | 2 | 1 |
| ZDMA-CONTAINING H-NBR | CONTENT OF ZINC METHACRYLATE (2a) | | 27.5 | | |
| | BOUND ACRYLONITRILE AMOUNT | | 36 | | |
| | MOONEY VISCOSITY ML1 + 4(100° C.) | | 57.5 | | |
| MASS OF FILLER (2a) FOR 100 PARTS BY MASS OF ENTIRE RUBBER COMPONENT | | | 46.8 | | |
| HARDNESS (JIS-A) | | 92 | 80 | 73 | 60 |
| MODULUS OF REPULSION ELASTICITY (%) | | 72 | 50 | 41 | 28 |
| TENSILE STRENGTH (MPa) | | 80 | 35 | 20 | 13 |
| TENSILE ELONGATION (%) | | 87 | 289 | 390 | 553 |

E and CE in the 3rd column indicate example and comparison example respectively.

The unit of each of the mixing amount of the rubber component (1), the filler (2), and the crosslinking agent (3) shown in table 1 is part by mass. The amount of the zinc methacrylate (2*a*) of the ZDMA-containing H-NBR is the amount (part by mass) of the zinc methacrylate (2*a*) contained in the ZDMA-containing H-NBR of the rubber component (1).

"Mass of filler (2*a*) for 100 parts by mass of entire rubber component" shown in table 1 means the sum of the fillers (2*a*) including the amount of the zinc methacrylate (2*a*) contained in the ZDMA-containing H-NBR for 100 parts by mass of the entire rubber component shown by the total mass of the rubber component other than the ZDMA-containing H-NBR and the H-NBR, serving as the base polymer, which is contained in the ZDMA-containing H-NBR.

The following products were used for the components shown in table 1:

NBR (acrylonitrile-butadiene rubber): "N232S" produced by JSR Inc. (bound acrylonitrile amount: 35%)

H-NBR (hydrogenated acrylonitrile-butadiene rubber): "Zetpol 2010H" produced by Zeon Corporation, bound acrylonitrile amount: 36%, Mooney viscosity: 145).

ZDMA-containing H-NBR (zinc methacrylate was finely dispersed in H-NBR used as the base polymer of the rubber component (1)): "Zeoforte ZSC 2195H" produced by Zeon Corporation (content of zinc methacrylate: 50 parts by mass)

Methacrylic acid: "MAA (commercial name)" produced by Mitsubishi Rayon Inc.

(1) Hardness (JIS-A): In accordance with JIS K 6253, the hardness of each of the cleaning blades of type A was measured by using a prepared compressed ball.

(2) Modulus of repulsion elasticity: By using a prepared compressed ball, the modulus of repulsion elasticity of each of the cleaning blades was measured at 23° C. in accordance with the LUPKE TYPE of JIS K 6255.

(3) Tensile strength: Dumbbell specimens No. 3 were punched out of prepared sheets each having a thickness of 2 mm to measure the tensile strength of each of the cleaning blades at a pulling rate of 500 mm/minute in accordance with JIS K 6251.

(4) Tensile elongation: Dumbbell specimens No. 3 were punched out of prepared sheets having a thickness of 2 mm to measure the elongation rate of each of the cleaning blades when the specimens were broken as a result of pulling at a pulling rate of 500 mm/minute in accordance with the tensile test of JIS K 6251.

After each sheet having a thickness of 2 mm was punched into the same size as that of the cleaning blade, each punched sheet was bonded to a supporting member made of chrome-free SECC with hot-melt. The central portion of the sheet was cut to obtain a cleaning member. The nip width and face pressure of each of the cleaning members were measured when a load shown in table 2 was applied thereto. Table 2 shows the results.

TABLE 2

| | COMPARISON EXAMPLE 1 | COMPARISON EXAMPLE 2 | EXAMPLE 1 | EXAMPLE 2 | EXAMPLE 3 | EXAMPLE 4 | EXAMPLE 5 | EXAMPLE 6 | COMPARISON EXAMPLE 3 |
|---|---|---|---|---|---|---|---|---|---|
| THERMOSETTING ELASTOMER COMPOSITION | A | A | B | B | B | C | C | C | D |
| NIP WIDTH (μm) | 2 | 2 | 3 | 3 | 3 | 10 | 10 | 10 | 15 |
| LOAD (N) | 2 | 40 | 2 | 40 | 60 | 4 | 10 | 40 | 40 |
| FACE PRESSURE(MPa) | 3.33 | 66.7 | 2.22 | 44.44 | 66.67 | 1.33 | 3.33 | 13.33 | 8.89 |
| NOISE-MAKING PHENOMENON | X | X | Δ | ○ | Δ | ○ | ○ | ○ | X |
| INVERSION PHENOMENON | X | X | ○ | ○ | ○ | ○ | ○ | ○ | X |
| WEAR RESISTANCE (μm) | 55 | 80 | 22 | 31 | 39 | 33 | 35 | 39 | 51 |
| CLEANING PERFORMANCE (100K PIECES) | 0.71 (1K PIECES) | 0.67 (1K PIECES) | 0.32 | 0.38 | 0.51 | 0.49 | 0.45 | 0.50 | 0.72 |
| OVERALL EVALUATION | X | X | ○ | ○ | Δ | ○ | ○ | ○ | X |

Zinc oxide: "Two kinds of zinc oxide (commercial name)" produced by Mitsui Kinzoku Inc.

Carbon black: "Sheast ISAF" (commercial name) produced by Tokai Carbon Inc.

Age resistor A (p,p'-dicumyldiphenylamine): "Knockluck CD" (commercial name) produced by Ouchi Shinko Kagaku Inc.)

Age resistor B (2-mercaptobenzimidazole): "Knockluck MB" (commercial name) produced by Ouchi Shinko Kagaku Inc.)

Sulfur-containing compound (diphenyl disulfide): "DPDS (commercial name)" produced by Sumitomo Seika Inc.

Organic peroxide (dicumyl peroxide): "Percumyl D" (commercial name) produced by Nippon Yushi Inc.)

The properties of the cleaning blades, composed of the thermosetting elastomer composition, of the examples and the comparison examples shown in tables 1 (A) through (D) were measured by the same method as that described above.

The nip width, the load, and the face pressure were measured by using the method same as that described above. That is:

(5) Nip width: The cleaning member was mounted on a measuring apparatus (not shown), produced by the present applicant, which has a function similar to that of an image-forming apparatus which has a rotary photoreceptor drum and is capable of developing polymerized toner.

Figure 1:
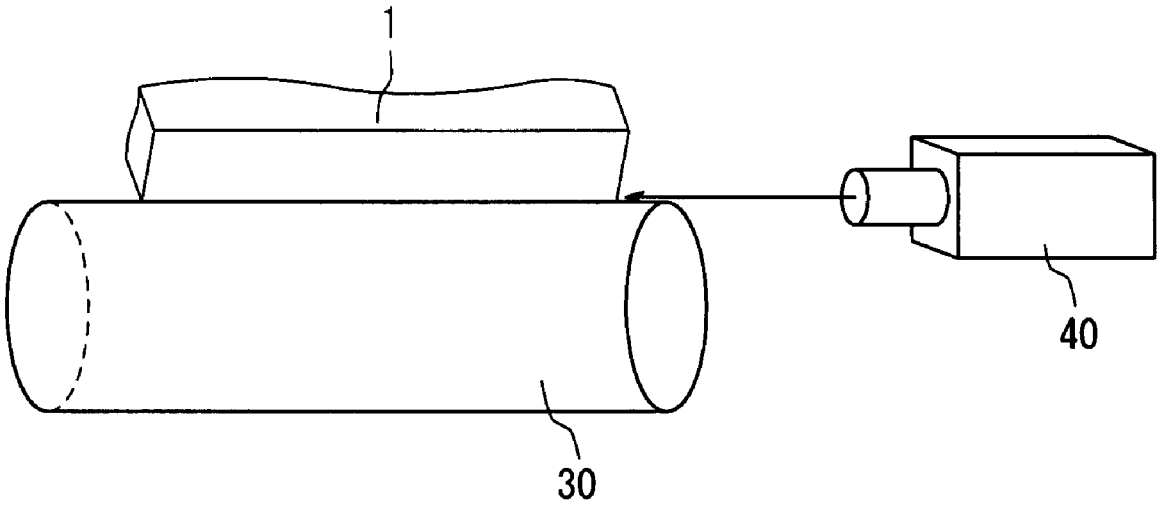
FIG. 1 is an explanatory view for explaining a method of observing a state in which a cleaning blade contacts a photoreceptor drum.
Figure 2A:
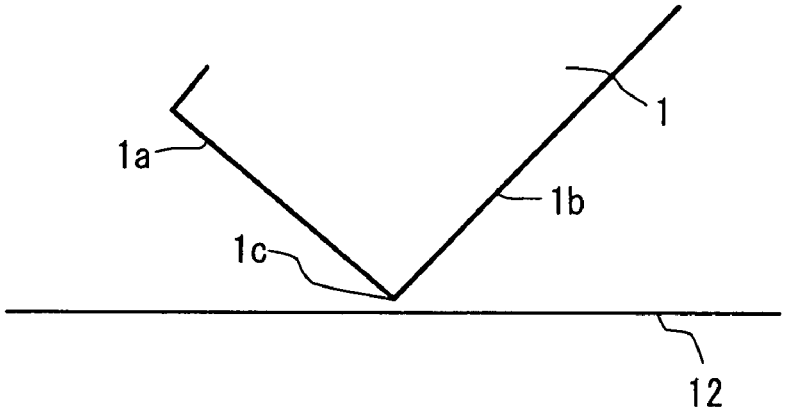
FIG. 2 is an explanatory view for explaining a state in which the cleaning blade contacts the photoreceptor drum; in which (A) shows a state before the cleaning blade contacts the photoreceptor drum, (B) shows a state in which the cleaning blade is in contact with the photoreceptor drum in a static state, and (C) shows a state in which the cleaning blade is in contact with the photoreceptor drum in the rotating static state in a dynamic state.
Figure 2B:
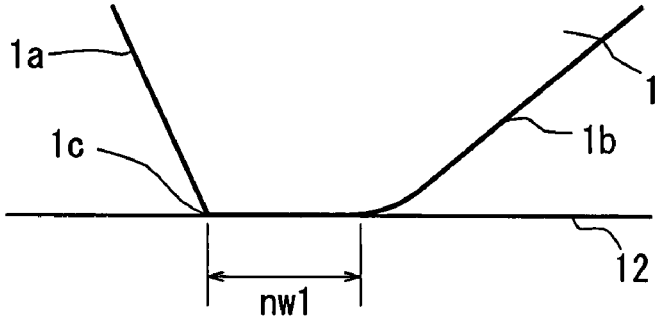
Figure 2C:
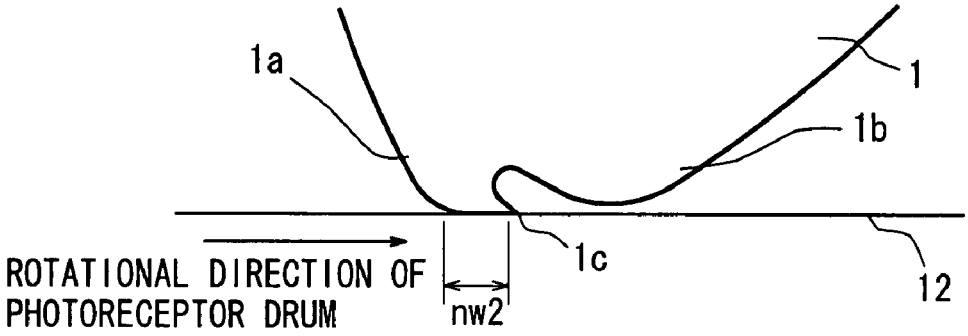
Figure 3A:
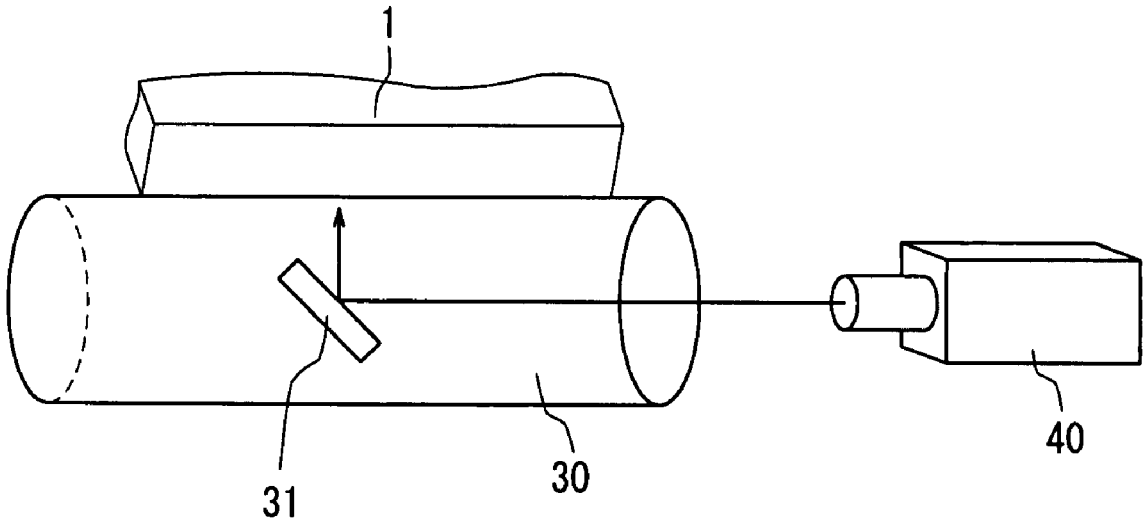
FIG. 3 is an explanatory view for explaining a method of measuring a nip width of a cleaning blade of a first embodiment of the present invention; in which (A) shows a method of observing the nip width, and (B) shows an observed image.
Figure 3B:
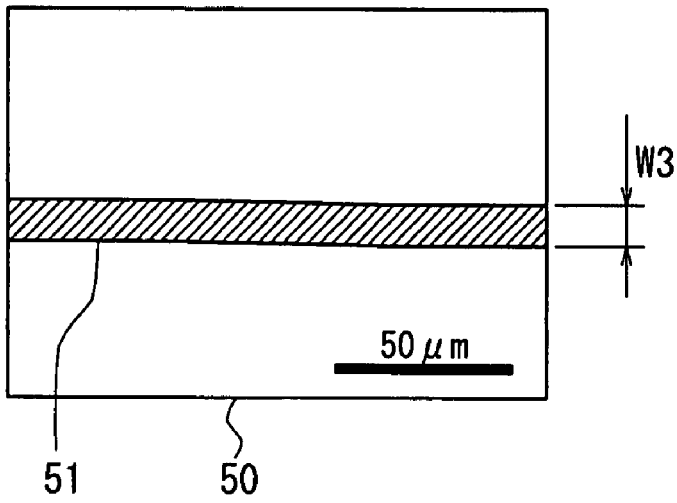

As shown in FIG. 3 (A), a transparent columnar glass 30, having a diameter of 30 mm, which accommodates a reflection mirror 31 was prepared. The cleaning blade 1 (20) was brought into contact with the columnar glass 30 at a load of 2 to 60 N. The same transparent material as a material applied to the surface of the photoreceptor drum was applied to the surface of the columnar glass 30.

Thereafter a high-speed camera (FASTCAM-APX-RS-250K produced by Photron Inc.) 40 was set alongside the columnar glass 30. The columnar glass 30 was rotated at a linear speed of 200 mm/second to photograph the cleaning blade 1 reflected on the reflection mirror 31 mounted inside the columnar glass 30 at a photographing speed of 100,000 fps and an exposure time of 10 μs.

As shown in FIG. 3 (B), a width W3 of a shade 51 of an observed image 50 was measured. The width W3 was converted by using a scale image measured separately to compute the nip width.

The nip width was found as an average value of eight static images selected at random from photographed images.

The test was conducted at a temperature of 23° C. and a relative humidity of 55%.

(6) Load: measured and observed by "PINCH-A3" produced by Nitta Co., Ltd.

(7) Face pressure: computed by using an equation shown below from the load, the nip width, and the length of the ridgeline of the cleaning blade:

Face pressure (MPa)=Load (N)/contact area ($mm^2$) of cleaning blade

Contact area ($mm^2$) of cleaning blade=nip width (mm)×length (mm) of ridgeline of cleaning blade The following evaluations were made on the cleaning blades.

Figure 9:
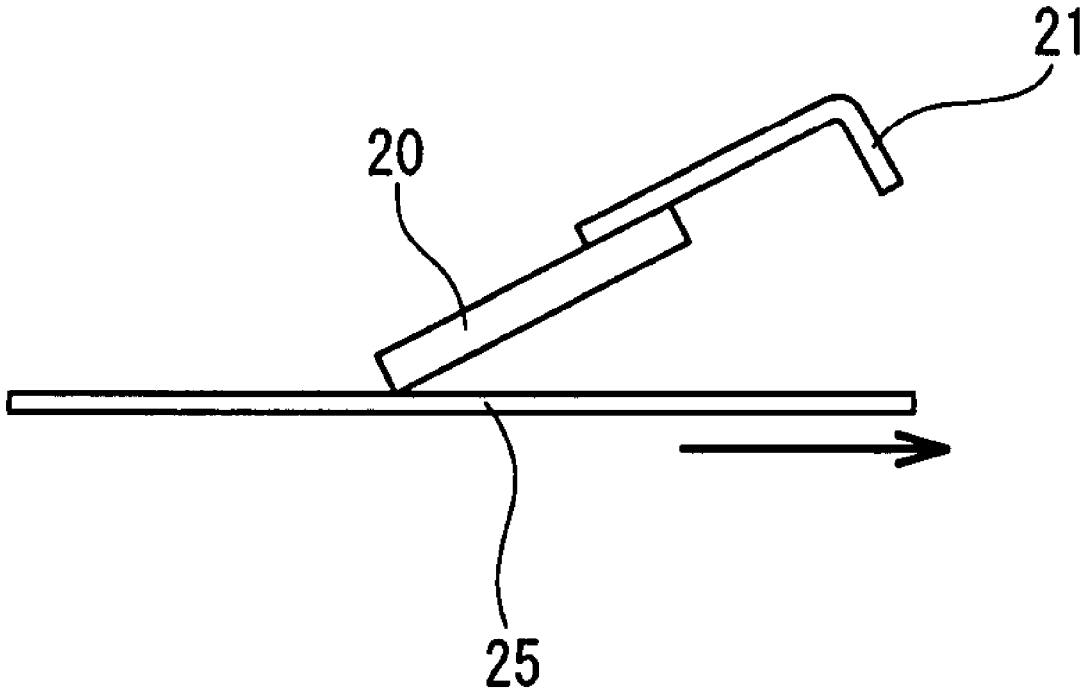
FIG. 9 is an explanatory view for explaining a method of evaluating a noise-making phenomenon and an inversion phenomenon of a cleaning blade and a method of measuring a dynamic friction coefficient of the cleaning blade.

(8) Evaluation of noise-making phenomenon and inversion phenomenon: As shown in FIG. 9, spherical polymerized toner (commercially available toner taken out of a commercially available printer produced by Canon Inc.) having a small diameter was attached to a horizontally placed glass plate 25 to which OPC (Organic Photo Conductor produced by the present applicant) was applied. The OPC-applied glass plate 25 was slid horizontally at 200 mm/second, with the cleaning blade 20 being held at an angle of 20 degrees to the OPC-applied glass plate 25 to observe a noise-making phenomenon and an inversion phenomenon. The test was conducted at a temperature of 23° C. and a relative humidity of 55%.

In table 2, the cleaning blades in which the noise-making phenomenon and the inversion phenomenon were not observed were marked by ○. Cleaning blades in which the noise-making phenomenon and the inversion phenomenon were observed to a slight extent were marked by Δ. Cleaning blades in which the noise-making phenomenon and the inversion phenomenon were observed to a high extent were marked by X.

(9) Evaluation of Wear Resistance

Figure 6A:
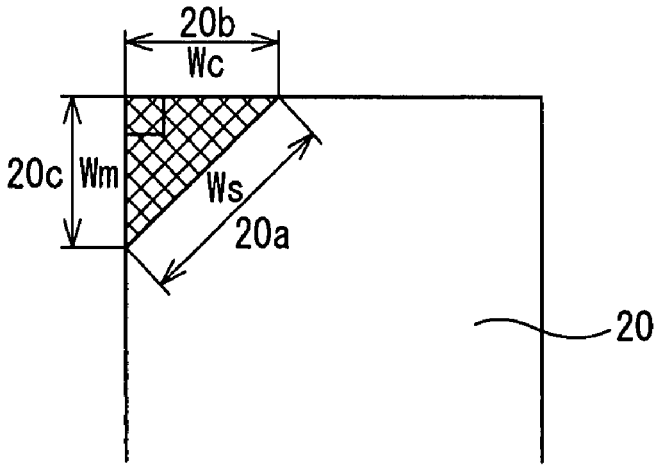
FIG. 6 is an explanatory view for explaining a method of evaluating a wear resistance test, in which (A) is an explanatory view for explaining a sectional length Ws of a wearing surface of a cleaning blade and (B) is an explanatory view for explaining a sectional length Ws 45 of the wearing surface of the cleaning blade.
Figure 6B:
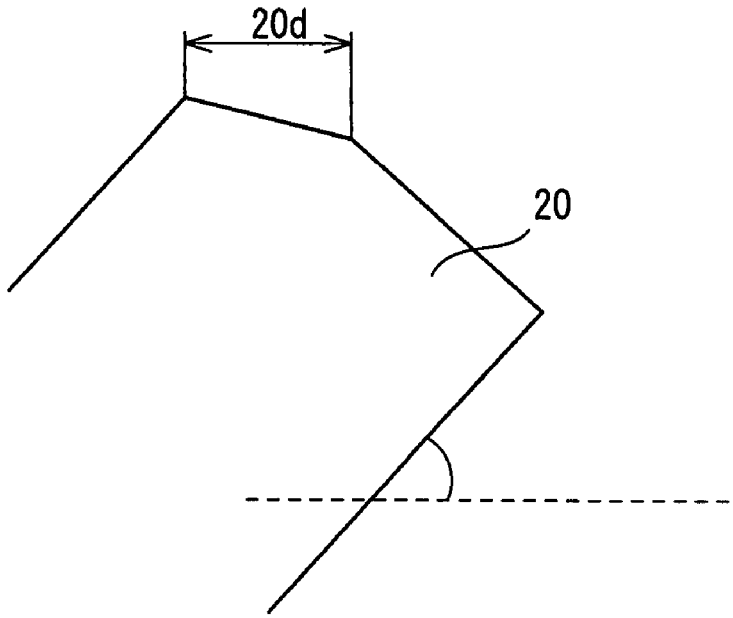

Each of the cleaning blades 20 was mounted on an image-forming apparatus (printer commercially available) in which a photoreceptor drum rotates and which is capable of forming an image. Printing was performed on 150,000 sheets of paper by setting the rotational speed of the photoreceptor drum to 200 mm to 500 mm/second and a printing concentration to 4%. Thereafter the edge of each cleaning blade was observed (FIG. 6 (A)). As shown in FIG. 6 (A), (B), a sectional length Ws45 (20*d*) of the wearing surface of the rubber of the cleaning blade was measured as a horizontal distance of the sectional length Ws (20*a*) of the wearing surface of the rubber thereof when the edge thereof inclined at 45 degrees. The wear resistance of each cleaning blade 23 was measured based on the sectional length Ws45 (20*d*). A reference numeral 20*b* of the cleaning blade denotes a wear width Wc, and 20*c* denotes a wear depth Wm.

The test was conducted at a normal temperature of 23° C. and a relative humidity of 55%.

In table 2, cleaning blades which had the wear resistance of not more than 40 μm were marked by ○. Cleaning blades which had the wear resistance of more than 40 μm were marked by x.

(10) Evaluation of Cleaning Performance:

Each of the cleaning blades 20 was mounted on an image-forming apparatus (manufactured by the present applicant) in which the photoreceptor drum rotates and which is capable of forming an image.

The amount of toner supplied to the photoreceptor drum (toner amount before cleaning blade scrapes surface of photoreceptor drum) per unit area was computed beforehand. After printing was performed on 100,000 sheets (100k pieces) at a printing concentration of 4%, the photoreceptor drum was rotated to remove the toner by the cleaning blade. Thereafter the amount of the toner present on the surface of the photoreceptor drum (toner amount which remains on surface of photoreceptor drum after cleaning blade scrapes surface thereof) disposed rearward from the cleaning blade was converted into an amount per unit area of the photoreceptor drum. Thereafter a value indicating the cleaning performance was evaluated based on: Cleaning performance=(toner amount which remains on surface of photoreceptor drum after cleaning blade scrapes surface thereof)/(toner amount before cleaning blade scrapes surface of photoreceptor drum). When it was judged that cleaning blades were defective because the noise-making phenomenon and the inversion phenomenon were observed before printing was performed on 100k pieces, printing operation was stopped and values indicating the cleaning performances thereof were computed.

The test was conducted at a normal temperature of 23° C. and a relative humidity of 55%. Perfectly spherical polymerized toner having a mean volume particle diameter of 5 to 10 μmm and a spherical degree of 0.90 to 0.99 was used.

Cleaning blades having a numerical value not more than 0.5 as the cleaning performance thereof is excellent. In table 2, cleaning blades having numerical values not more than 0.5 were marked by ○; those having numerical values more than 0.5 nor more than 0.7 were marked by Δ; and those having numerical values more than 0.7 were marked by x.

Based on evaluations made on four items including the noise-making phenomenon, the inversion phenomenon, the wear resistance, and the cleaning performance, cleaning blades having not less than three ○ and not having X were marked by ○; cleaning blades having not less two ○ and not having x were marked by Δ; and cleaning blades having not less one x were marked by x.

As shown in table 2, the cleaning blades of the examples 1 through 6 formed from the thermosetting elastomer composition having the compositions (B) or (C) were marked by ○ as the overall evaluation except the cleaning blade of the example 3 which applied a load of 60 N to the photoreceptor drum had 0.51 as its cleaning performance and generated the noise-making phenomenon to a slight extent and was thus marked by Δ as the overall evaluation. The cleaning blades of the examples had the nip width in the range of 3 to 10 μm at the time when the photoreceptor drum was rotating. Thus the cleaning blades of the examples did not generate the noise-making phenomenon nor the inversion phenomenon and were excellent in the wear resistance and cleaning performance thereof.

On the other hand, the cleaning blades of the comparison examples 1 through 3, formed from the thermosetting elastomer composition having the compositions (A) or (D), which applied a load of 60 N to the photoreceptor drum had the nip width out of the range of 3 to 10 μm at the time when the photoreceptor drum was rotating and were thus marked by x as the overall evaluation. The cleaning blades of the comparison examples 1 through 3 were inferior to those of the examples 1 through 6 in all the items of the evaluations.

Figure 7A:
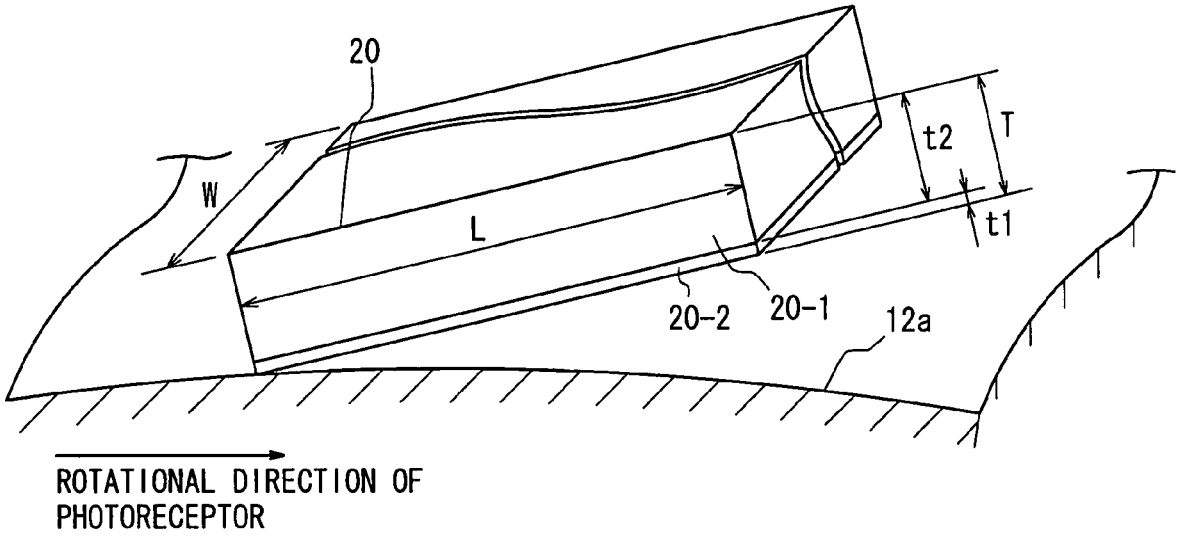
FIG. 7 is an explanatory view for explaining a cleaning blade, of a second embodiment of the present invention, having a two-layer construction in a thickness direction, in which (A) is a front view showing the disposition of an edge layer and a matrix layer, and (B) is an explanatory view for explaining a method of forming an edge of the cleaning blade of (A).
Figure 7B:
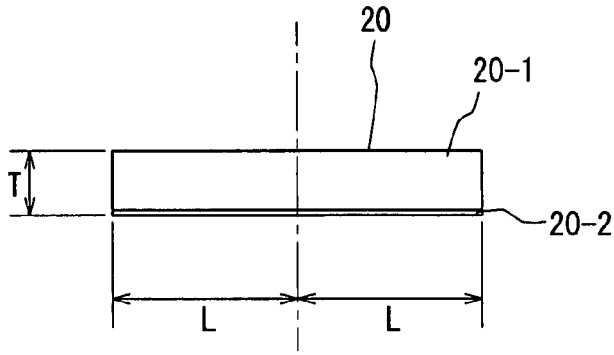

FIG. 7 shows the second embodiment of the cleaning blade of the present invention.

The cleaning blade 20 of the second embodiment has a two-layer construction composed of a matrix layer 20-1 and an edge layer 20-2.

The edge layer 20-2 is fixed entirely to one surface of the matrix layer 20-1 in its thickness direction with the edge layer 20-2 confronting a photoreceptor. More specifically, the cleaning blade 20 has the two-layer construction composed the edge layer 20-2 disposed at the side contacting a surface 12*a* of a photoreceptor drum 12 and the matrix layer 20-1 not contacting the surface 12*a* of the photoreceptor drum 12.

Supposing that the thickness of the edge layer 20-2 is t1 and that the thickness of the matrix layer 20-1 is t2, t1<t2. The thickness t1 of the edge layer 20-2 is set to 0.05 to 0.5 mm. The thickness t2 of the matrix layer 20-1 is set to 1.5 to 1.95 mm. The thickness T (t1+t2=T) of the cleaning blade 20 is set to 1 to 3 mm.

When the edge layer 20-2 and the matrix layer 20-1 are integrated with each other, the length L of the cleaning blade 20 is set to 10 mm to 40 mm, and a width W thereof orthogonal to the length thereof is set to 200 mm to 500 mm.

The matrix layer 20-1 of the cleaning blade of the present invention has a hardness (JIS-A) of 60 to 90, a modulus of repulsion elasticity of 20 to 70%, a compression set of 0 to 10%, a tensile strength of 10 to 80 MPa, and a tensile elongation of 100 to 600%. The edge layer 20-2 of the cleaning blade has a hardness (JIS-A) of 60 to 90, a modulus of repulsion elasticity of 25 to 70%, a dynamic friction coefficient of 0.5 to 1.5, a tensile strength of 10 to 80 MPa, and a tensile elongation of 100 to 600%. The properties of the matrix layer 20-1 and those of the edge layer 20-2 are different from each other in the above-described ranges.

The edge layer 20-2 is made of a high-hardness material and has a hardness of not less than 70 nor more than 90 and a modulus of repulsion elasticity of not less than 20% and less than 45%. The matrix layer 20-1 is made of a low-hardness material and has a hardness of not less than 60 and less than 75 and a modulus of repulsion elasticity of not less than 35% nor more than 70%.

The edge layer 20-2 and the matrix layer 20-1 are formed of the thermosetting elastomer composition similarly to the cleaning blade of the first embodiment and contains at least the rubber component (1), the filler (2*a*, 2*b*), and the crosslinking agent (3). Sheets composing the matrix layer 20-1 and the edge layer 20-2 are formed by using known methods such as injection molding or compression molding.

The obtained sheets composing the edge layer and the matrix layer were set in a die with the sheets layered on each other and press-vulcanized at 60° C. for 30 minutes to bond the sheets to each other by vulcanization. Thereafter as shown with a dash line of FIG. 7 (B), a central portion of each sheet was cut to form a ridgeline to form the cleaning blade 20.

Similarly to the first embodiment, one end of the cleaning blade 20 in its longitudinal direction was bonded to a supporting member 21 with an adhesive agent.

In the cleaning blade 20 for use in the image-forming apparatus of the second embodiment, the edge layer is made of the material having a high hardness, whereas the matrix layer is made of the material having a low hardness. The edge layer and the matrix layer are integrated with each other so that a required pressure and elasticity are entirely applied to the cleaning blade. Therefore the cleaning blade follows fine irregularities of the surface of the photoreceptor drum with the cleaning blade applying a high linear pressure to the photoreceptor drum 12. Further the cleaning blade is excellent in its wear resistance and the performance of cleaning the spherical polymerized toner having a small diameter.

Instead of the cleaning blade 20 of the second embodiment, it is possible to use the thermosetting elastomer composition composing the matrix layer 20-1 for the edge layer 20-2 and use the thermosetting elastomer composition composing the edge layer 20-2 for the matrix layer 20-1 so that a cleaning blade is composed by replacing the matrix layer 20-1 and the edge layer 20-2 with each other.

In this case, more specifically, the edge layer is made of a material having a low hardness of not less than 60 nor more than 75 and a modulus of repulsion elasticity of not less than 35% nor more than 70%, and the matrix layer is made of a material having high hardness of not less than 70 nor more than 90 and a modulus of repulsion elasticity of not less than 20% nor more than 45%.

As described above, even when the cleaning blade has the two-layer construction composed of the edge layer made of the material having a low hardness and the matrix layer made of the material having a high hardness, a required pressure and elasticity are entirely applied to the cleaning blade. Therefore similarly to the cleaning blade of the first and second embodiments, this cleaning blade does not generate the noise-making phenomenon nor the inversion phenomenon and excellent in its wear resistance and the performance of cleaning the spherical polymerized toner having a small diameter.

Figure 8A:
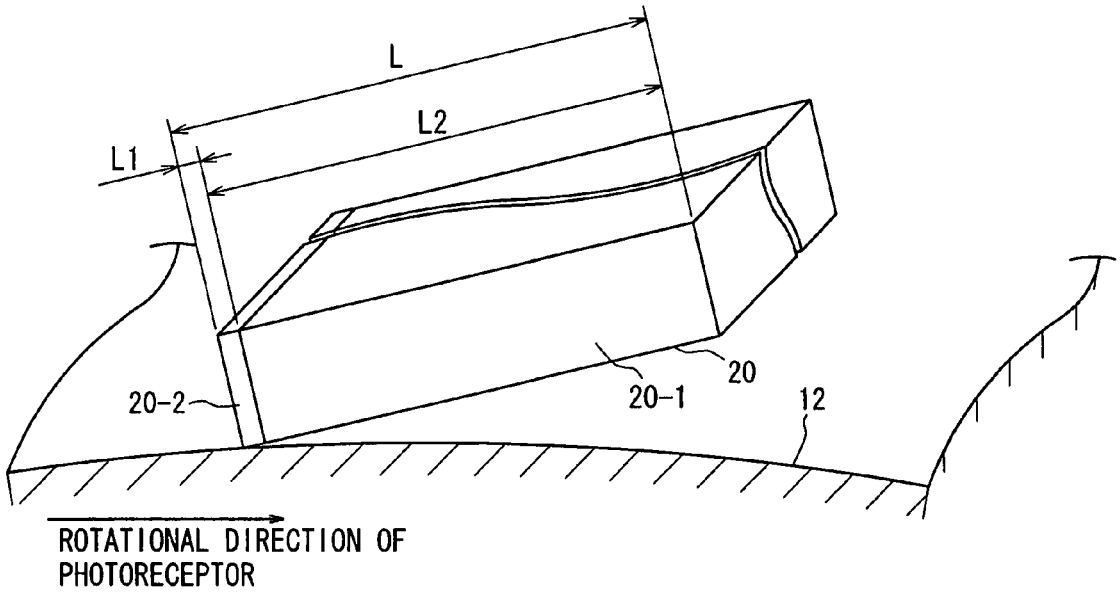
FIG. 8 is an explanatory view for explaining a cleaning blade, of a third embodiment of the present invention, having a two-layer construction in a width direction, in which (A) is a front view showing the disposition of an edge layer and a matrix layer, and (B) is a plan view of (A), and (C) is an explanatory view for explaining a method of forming an edge of the cleaning blade of (A).
Figure 8B:
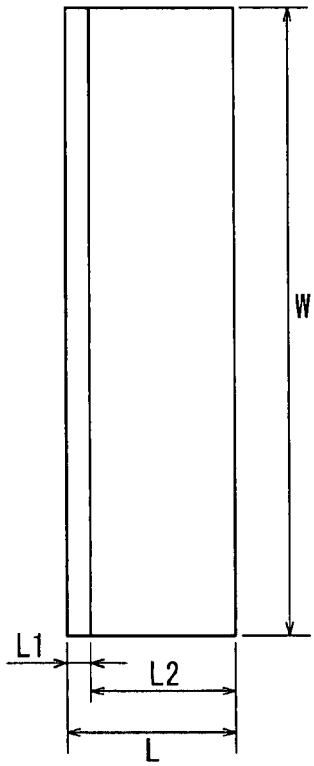
Figure 8C:
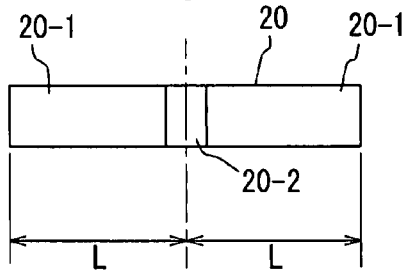

FIG. 8 shows the cleaning blade 20 of the third embodiment.

The matrix layer 20-1 and the edge layer 20-2 of the cleaning blade 20 of the third embodiment are different from those of the second embodiment in the disposing direction thereof.

Sheet materials composing the matrix layer 20-1 and the edge layer 20-2 are similar to those of the second embodiment. But the cleaning blade 20 of the third embodiment has a two-layer construction in a length L direction of the cleaning blade 20. The edge layer 20-2 is fixed to a front-end surface of the matrix layer 20-1 in its length direction. That is, the edge layer 20-2 is disposed at an upstream side of the photoreceptor 12 in its rotational direction, whereas the matrix layer 20-1 disposed at a downstream side of the photoreceptor 12 in its rotational direction thereof.

Supposing that the length of the edge layer 20-2 of the cleaning blade of the third embodiment is L1 and that the length of the matrix layer 20-1 thereof is L2, L1<L2. The length L1 of the edge layer 20-2 is set to 0.05 to 0.5 mm. The length L2 of the matrix layer 20-1 is set to 11.9 to 12.35 mm, and the entire length L of the cleaning blade 20 is set to 11.95 to 12.85 mm.

When the edge layer 20-2 and the matrix layer 20-1 are integrated with each other, an entire width W of the cleaning blade 20 orthogonal to the length thereof is set to 200 mm to 500 mm.

Unlike the second embodiment, vulcanization adhesion is not performed in the third embodiment but adhesion is performed by using an adhesive agent. More specifically, the compositions composing the edge layer and the matrix layer are molded into sheets, and press-vulcanized sheets are bonded to each other with the adhesive agent.

More specifically, as shown in FIG. 8 (C), a sheet composing the edge layer 20-2 is glued between the edge of two sheets composing the matrix layer 20-1, and a central portion (one-dot chain line shown in FIG. 8 (C)) of the sheet composing the edge layer 20-2 is cut to form a ridgeline.

As the adhesive agent, vulcanization adhesive agent, a cyanoacrylate adhesive agent, and a hot melt adhesive agent are used.

Because the cleaning blade of the third embodiment has the edge layer at the front-end surface thereof in its width direction, the edge layer can be formed by using a small mount of a material.

Other constructions and effect of the third embodiment are similar to those of the second embodiment. Thus the same parts of the third embodiment as those of the second embodiment are denoted by the same reference numerals as those of the second embodiment, and description thereof is omitted herein.

Instead of the cleaning blade of the third embodiment, it is possible to use the thermosetting elastomer composition composing the matrix layer for the edge layer and use the thermosetting elastomer composition composing the edge layer for the matrix layer so that a cleaning blade is composed by replacing the matrix layer and the edge layer with each other.

In this case, more specifically, the edge layer 20-2 is made of a material having a low hardness of not less than 60 nor more than 75 and a modulus of repulsion elasticity of not less than 35% nor more than 70%, and the matrix layer 20-1 is made of a material having high hardness of not less than 70 nor more than 90 and a modulus of repulsion elasticity of not less than 20% nor more than 45%.

As described above, even when the cleaning blade has the two-layer construction composed of the edge layer made of the material having a low hardness and the matrix layer made of the material having a high hardness, a required pressure and elasticity are entirely applied to the cleaning blade. Therefore similarly to the cleaning blade of the second and third embodiments, this cleaning blade does not generate the noise-making phenomenon nor the inversion phenomenon and excellent in its wear resistance and the performance of cleaning the spherical polymerized toner having a small diameter.

Examples 7 through 14 of the second and third embodiments of the present invention and comparison examples 4 through 6 are described below.

EXAMPLES 7 THROUGH 12 AND COMPARISON EXAMPLES 4 THROUGH 6

After the mixing amount (composition E through J) of each of the rubber component (1) and the filler (2) shown in table 3 were measured, the rubber component (1) and the filler (2*b*) were supplied to a rubber kneading apparatus such as a biaxial extruder, an open roll, a Banbury mixer or a kneader. Thereafter they were kneaded for five to six minutes while they were being heated at 80° C. to 120° C.

The obtained mixture and the crosslinking agent (3), the mixing amount (composition E through J) of which is shown in table 3 were supplied to the rubber kneading apparatus such as the open roll, the Banbury mixer or the kneader. Thereafter they were kneaded for five to six minutes while they were being heated to 80° C. to 90° C.

After each of the obtained thermosetting elastomer compositions (composition E through J) was set in a die, they were press-vulcanized respectively at 160° C. to 170° C. for about 30 minutes to obtain sheets composing the matrix layers and the edge layers having the constructions (thickness and combination) shown in table 4.

Thereafter properties of sheets composing the matrix layer and the edge layer before they were bonded to each other were measured. The results of the measurement are as shown in table 4.

EXAMPLES 13, 14

Commercially available polyurethane rubber sheets (commercially available articles 1 and 2) were used as the matrix layers and the edge layers.

Table 4 shows the results of the measurement.

TABLE 3

| | | COMPOSITION E | COMPOSITION F | COMPOSITION G | COMPOSITION H | COMPOSITION I | COMPOSITION J | COMPOSITION K | COMPOSITION L |
|---|---|---|---|---|---|---|---|---|---|
| RUBBER COMPONENT (1) | H-NBR (RUBBER a) | 100 | 100 | 100 | 100 | 70 | 30 | | |
| | ZDMA-CONTAINING H-NBR (1a) | | | | | 30 | 70 | | |
| | POLYURETHANE RUBBER 1 | | | | | | | COMMERCIALLY AVAILABLE ARTICLE 1 | |
| | POLYURETHANE RUBBER 2 | | | | | | | | COMMERCIALLY AVAILABLE ARTICLE 2 |
| FILLER (2) | CARBON BLACK | 1 | 50 | 1 | 70 | | | | |
| | METHACRYLIC ACID | 10 | 10 | 3 | 10 | | | | |
| | ZINC OXIDE | 10 | 10 | 3 | 10 | | | | |
| | AGE RESISTOR A | 1 | 1 | 1 | 1 | 1 | 1 | | |
| | AGE RESISTOR B | 2 | 2 | 2 | 2 | 2 | 2 | | |
| CROSSLINKING AGENT (3) | ORGANIC PEROXIDE | 3 | 3 | 3 | 3 | 3 | 3 | | |
| ZDMA-CONTAINING H-NBR | CONTENT OF ZINC METHACRYLATE (2a) | | | | | 15 | 35 | | |
| | BOUND ACRYLONITRILE AMOUNT | | | | | 36 | 36 | | |
| | MOONEY VISCOSITY ML1 + 4(100° C.) | | | | | 145 | 145 | | |

TABLE 3-continued

| | COMPO-SITION E | COMPO-SITION F | COMPO-SITION G | COMPO-SITION H | COMPO SITION I | COMPO-SITION J | COMPO-SITION K | COMPO-SITION L |
|---|---|---|---|---|---|---|---|---|
| MASS OF FILLER (2a) FOR 100 PARTS BY MASS OF ENTIRE RUBBER COMPONENT | 20 | 20 | 6 | 20 | 17.6 | 53.8 | | |

TABLE 4-1

| | | EXAM-PLE 7 | EXAM-PLE 8 | EXAM-PLE 9 | EXAMPLE 10 | EXAMPLE 11 | EXAMPLE 12 | EXAMPLE 13 | EXAMPLE 14 |
|---|---|---|---|---|---|---|---|---|---|
| MATRIX LAYER | COMPOSITION | E | E | F | F | I | J | K | L |
| | HARDNESS (JIS-A) | 60 | 60 | 89 | 89 | 67 | 90 | 73 | 90 |
| | MODULUS OF REPULSION ELASTICITY (%) | 59 | 59 | 26 | 26 | 51 | 45 | 35 | 25 |
| | TENSILE PERMANENT SET (%) | 7 | 7 | 9 | 9 | 10 | 10 | 4 | 2 |
| | TENSILE STRENGTH (MPa) | 46 | 46 | 34 | 34 | 27 | 54 | 52 | 79 |
| | TENSILE ELONGATION (%) | 500 | 500 | 260 | 260 | 422 | 350 | 432 | 464 |
| | THICKNESS (mm) CONSTRUCTION [TYPE A] | 1.95 | — | 1.5 | — | 1.95 | 1.95 | 1.95 | 1.95 |
| | LENGTH (mm) CONSTRUCTION [TYPE B] | — | 12.35 | — | 11.9 | — | — | — | — |
| EDGE LAYER | COMPOSITION | F | F | E | E | J | I | L | K |
| | HARDNESS (JIS-A) | 89 | 89 | 60 | 60 | 90 | 67 | 90 | 73 |
| | MODULUS OF REPULSION ELASTICITY (%) | 26 | 26 | 59 | 59 | 45 | 51 | 25 | 35 |
| | TENSILE STRENGTH (MPa) | 34 | 34 | 46 | 46 | 54 | 27 | 79 | 52 |
| | TENSILE ELONGATION (%) | 260 | 260 | 500 | 500 | 350 | 422 | 464 | 432 |
| | DYNAMIC FRICTION COEFFICIENT | 0.8 | 0.8 | 1.4 | 1.4 | 0.7 | 1.2 | 1.1 | 1.5 |
| | THICKNESS (mm) | 0.05 | 0.05 | 0.5 | 0.5 | 0.05 | 0.05 | 0.05 | 0.05 |
| NOISE-MAKING PHENOMENON | | ○ | ○ | ○ | ○ | ○ | ○ | ○ | ○ |
| INVERSION PHENOMENON | | ○ | ○ | ○ | ○ | ○ | ○ | ○ | ○ |
| WEAR RESISTANCE (μm) | | 15 | 19 | 15 | 11 | 11 | 15 | 17 | 18 |
| CLEANING PERFORMANCE (100K PIECES) | | 0.40 | 0.45 | 0.41 | 0.38 | 0.39 | 0.42 | 0.37 | 0.47 |

TABLE 4-2

| | | COMPARISON EXAMPLE 4 | COMPARISON EXAMPLE 5 | COMPARISON EXAMPLE 6 |
|---|---|---|---|---|
| MATRIX LAYER | COMPOSITION | G | H | H |
| | HARDNESS (JIS-A) | 55 | 95 | 95 |
| | MODULUS OF REPULSION ELASTICITY (%) | 18 | 75 | 75 |
| | TENSILE PERMANENT SET (%) | 12 | 30 | 30 |
| | TENSILE STRENGTH (MPa) | 9 | 71 | 71 |
| | TENSILE ELONGATION (%) | 650 | 90 | 90 |
| | THICKNESS (mm) CONSTRUCTION [TYPE A] | 1.3 | 1.3 | — |
| | LENGTH (mm) CONSTRUCTION [TYPE B] | — | — | 11.5 |
| EDGE LAYER | COMPOSITION | H | G | G |
| | HARDNESS (JIS-A) | 95 | 55 | 55 |
| | MODULUS OF REPULSION ELASTICITY (%) | 75 | 18 | 18 |
| | TENSILE STRENGTH (MPa) | 71 | 9 | 9 |
| | TENSILE ELONGATION (%) | 90 | 650 | 650 |
| | DYNAMIC FRICTION COEFFICIENT | 1.6 | 1.6 | 1.6 |
| | THICKNESS (mm) | 0.7 | 0.7 | 0.9 |
| NOISE-MAKING PHENOMENON | | Δ | X | X |
| INVERSION PHENOMENON | | Δ | XX | X |
| WEAR RESISTANCE (μm) | | 55 | 41 | 44 |
| CLEANINGPERFORMANCE(100KPIECES) | | 0.65 (1K PIECES) | 0.61 (1K PIECES) | 0.54 (0.5K PIECES) |

The unit of each of the mixing amount of the rubber component (1), the filler (2), and the crosslinking agent (3) shown in table 3 is part by mass. The following products were used for the components shown in table 3:

H-NBR (hydrogenated acrylonitrile-butadiene rubber): As the H-NBR which is the base polymer, "Zetpol 2010H" produced by Zeon Corporation was used (Bound acrylonitrile amount: 36%, Mooney viscosity: 145).

ZDMA-containing H-NBR (zinc methacrylate was finely dispersed in H-NBR used as the base polymer: "Zeoforte ZSC 2195H" produced by Zeon Corporation. (content of zinc methacrylate: 50 parts by mass)

Polyurethane rubber 1: polyurethane rubber sheet commercially available

Polyurethane rubber 2: polyurethane rubber sheet commercially available

Methacrylic acid: "MAA (commercial name)" produced by Mitsubishi Rayon Inc.

Zinc oxide: "Two kinds of zinc oxide (commercial name)" produced by Mitsui Kinzoku Inc.

Carbon black: "Sheast ISAF" produced by Tokai Carbon Inc.

Age resistor A (p,p'-dicumyldiphenylamine): "Knockluck CD" produced by Ouchi Shinko Kagaku Inc.)

Age resistor B (2-mercaptobenzimidazole): "Knockluck MB" produced by Ouchi Shinko Kagaku Inc.)

Organic peroxide (dicumyl peroxide): "Percumyl D" produced by Nippon Yushi Inc.)

The properties shown in table 4 were measured by the same method as that described above.

(1) Hardness (JIS-A): In accordance with JIS K 6253, the hardness of each of the sheets of type A was measured by using a prepared compressed ball.

(2) Modulus of repulsion elasticity: By using a prepared compressed ball, the modulus of repulsion elasticity of each of the sheets was measured at 23° C. in accordance with the LUPKE TYPE of JIS K 6255.

(3) Tensile strength: Dumbbell specimens No. 3 were punched out of prepared sheets respectively to measure the tensile strength of each of the sheets at a pulling rate of 500 mm/minute in accordance with JIS K 6251.

(4) Tensile elongation: Dumbbell specimens No. 3 were punched out of prepared sheets respectively to measure the elongation rate of each of the sheets when the specimens were broken as a result of pulling at a pulling rate of 500 mm/minute in accordance with the tensile test of JIS K 6251.

(5) tensile permanent set: Dumbbell specimens No. 4 were punched out of prepared sheets respectively to measure the tensile permanent set of each of the sheets in accordance with JIS K 6262.

(6) Dynamic friction coefficient: As shown in FIG. 9, the dynamic friction coefficient was computed from a sliding resistance of a cleaning blade 20 to an OPC-applied glass (glass to which OPC (Organic Photo Conductor) 25 produced by the present applicant was applied). To do so, after the cleaning blade 20 having a length of 20 mm formed from a sheet having a thickness of 2 mm was bonded to a supporting member 21, the supporting member was mounted on a surface property measuring apparatus (type 14 produced by Shinto Kagaku Co., Ltd.) at an angle of 20 degrees. Thereafter the OPC-applied glass 25 was moved at a load of 0.59 N and a moving speed of 100 mm/second by a counter method. The dynamic friction coefficient is measured five times. The dynamic friction coefficient was obtained by measuring it five times and taking an average value of three values except maximum and minimum values.

(7) Thickness and length of each layer: measured with a dial gauge or a scale.

Cleaning blades each having a construction shown in table 4 were prepared.

The construction of the cleaning blades of the examples 7, 9, 11 through 14 and the comparison examples 4 and 5 were of the type A shown in FIG. 7 in which the edge layer and the matrix layer were layered on each other in the thickness direction thereof. Sheets composing the edge layer and the matrix layer were cut so that the each cleaning blade had a desired width and length. After the sheets were bonded to each other in the thickness direction of the edge layer and the matrix layer with a cyano adhesive agent (401 produced by LOCTITE Inc.), the sheets were bonded to a supporting member made of chrome-free SECC with hot melt (made of diamond). The central portions of the sheets were cut to form a ridgeline. In this manner, cleaning blades each having a two-layer construction in the thickness direction thereof were formed.

The construction of the cleaning blades of the examples 8 and 10 and the comparison example 6 were of the type B shown in FIG. 8 in which the edge layer and the matrix layer were layered on each other in the width direction thereof. After sheets composing the edge layer and the matrix layer were bonded to each other with the cyano adhesive agent (401 produced by LOCTITE Inc.), the sheets were bonded to the supporting member made of the chrome-free SECC with the hot melt (made of diamond). The central portions of the sheets were cut to form a ridgeline. In this manner, cleaning blades each having a two-layer construction having the edge layer formed on the front-end surface of the matrix layer along the width direction thereof were formed.

The cleaning blades 20 of the examples 7 through 14 and the comparison examples 4 through 6 were bonded to the supporting members 21 respectively to form cleaning members, and the following performance evaluation was performed.

The noise-making phenomenon, inversion phenomenon, wear resistance, cleaning performance of each cleaning blade were evaluated by using the method similar to that of the examples 1 through 6.

As shown in table 4, the cleaning blades of the examples 7 through 14 did not generate the noise-making phenomenon nor the inversion phenomenon, were excellent in the wear resistance, and had a numerical value of not more than 0.5 as the cleaning performance thereof. Thus it was confirmed that the cleaning blades of the examples 7 through 14 were excellent.

On the other hand, as apparent from table 4, it was confirmed that the cleaning blades of the comparison examples 4 through 6 were inferior to those of the examples 7 through 14 in all the items of the evaluations.

What is claimed is:

1. A cleaning blade, for use in an image-forming apparatus, which is brought into contact with a peripheral surface of a photoreceptor drum of an image-forming apparatus to remove toner which remains on said peripheral surface of said photoreceptor drum, said cleaning blade being molded from a thermosetting elastomer composition containing a rubber component (1), a filler (2), and a crosslinking agent (3), said thermosetting elastomer composition essentially containing 5 to 60 parts by mass of zinc methacrylate (2*a*) or 5 to 60 parts by mass of a mixture (2*a*) of methacrylic acid and zinc oxide as said filler (2) for 100 parts by mass of said rubber component (1) or said thermosetting elastomer composition containing 10 to 75 parts by mass of a mixture (1*a*) of hydrogenated acrylonitrile-butadiene rubber serving as a base polymer thereof and said zinc methacrylate dispersed in said hydrogenated acrylonitrile-butadiene rubber in 100 parts by mass of said rubber component (1), wherein in a dynamic state in which said cleaning blade contacts said photoreceptor drum with a load of 2 to 60 N and a face pressure of 1.3 to 66.7 MPa being applied thereto when said photoreceptor drum is rotating, said cleaning blade contacts said peripheral surface of said photoreceptor drum in a contact width (nip width) of 3 to 10μm.

2. The cleaning blade, for use in an image-forming apparatus according to claim 1, which is composed of said thermosetting elastomer composition and has a hardness (JIS-A)

of 60 to 90, a modulus of repulsion elasticity of 20 to 70%, a tensile strength of 10 to 80 MPa, and a tensile elongation of 100 to 600%.

3. The cleaning blade for use in an image-forming apparatus according to claim 2, wherein said cleaning blade has a two-layer construction in a thickness direction thereof formed from a matrix layer and an edge layer, and formed by molding said thermosetting elastomer composition; a thickness t2 of said matrix layer is set larger than a thickness t1 of said edge layer, and a length of said matrix layer is set same to that of said edge layer; said thickness t1 of said edge layer is set to 0.05 to 0.5 mm; and said edge layer is brought into contact with said photoreceptor drum; and a tensile permanent set of said matrix layer is set to 0 to 10%; and a dynamic friction coefficient of said edge layer is set to 0.5 to 1.5.

4. The cleaning blade for use in an image-forming apparatus according to claim 3, wherein the thickness t2 of said matrix layer is set to 1.5 to 1.95 mm.

5. The cleaning blade for use in an image-forming apparatus according to claim 2, wherein said cleaning blade has a two-layer construction in a length direction thereof formed from a matrix layer and an edge layer, and formed by molding said thermosetting elastomer composition; a length L2 of said matrix layer is set larger than a length L1 of said edge layer, and a thickness of said matrix layer is set to be the same as that of said edge layer; said length L1 of said edge layer is set to 0.05 to 0.5 mm; and said edge layer is brought into contact with said photoreceptor drum; and a tensile permanent set of said matrix layer is set to 0 to 10%; and a dynamic friction coefficient of said edge layer is set to 0.5 to 1.5.

6. The cleaning blade for use in an image-forming apparatus according to claim 5, wherein said length L2 of said matrix layer is set to 11.9 to 12.35 mm.

7. The cleaning blade for use in an image-forming apparatus according to claim 3, wherein properties of said edge layer and those of said matrix layer are different from each other;

said edge layer is made of a high-hardness material having a hardness, a modulus of repulsion elasticity, a tensile strength, and a tensile elongation each falling in a range; and said matrix layer is made of a low-hardness material having a hardness, a modulus of repulsion elasticity, a tensile strength, and a tensile elongation each falling in a range; or said edge layer is made of a low-hardness material having a hardness, a modulus of repulsion elasticity, a tensile strength, and a tensile elongation each falling in a range; and said matrix layer is made of a high-hardness material having a hardness, a modulus of repulsion elasticity, a tensile strength, and a tensile elongation each falling in a range.

8. The cleaning blade for use in an image-forming apparatus according to claim 5, wherein properties of said edge layer and those of said matrix layer are different from each other;

said edge layer is made of a high-hardness material having a hardness, a modulus of repulsion elasticity, a tensile strength, and a tensile elongation each falling in a range; and said matrix layer is made of a low-hardness material having a hardness, a modulus of repulsion elasticity, a tensile strength, and a tensile elongation each falling in a range; or said edge layer is made of a low-hardness material having a hardness, a modulus of repulsion elasticity, a tensile strength, and a tensile elongation each falling in a range; and said matrix layer is made of a high-hardness material having a hardness, a modulus of repulsion elasticity, a tensile strength, and a tensile elongation each falling in a range.

9. The cleaning blade for use in an image-forming apparatus according to claim 7, wherein said edge layer has a hardness of not less than 60 and less than 75 and a modulus of repulsion elasticity of not less than 35% nor more than 70%, and said matrix layer has a hardness of not less than 70 nor more than 90 and a modulus of repulsion elasticity of not less than 20% and less than 45%; or said edge layer has a hardness of not less than 70 nor more than 90 and a modulus of repulsion elasticity of not less than 20% and less than 45%, and said matrix layer has a hardness of not less than 60 and less than 75 and a modulus of repulsion elasticity of not less than 35% nor more than 70%.

10. The cleaning blade for use in an image-forming apparatus according to claim 8, wherein said edge layer has a hardness of not less than 60 and less than 75 and a modulus of repulsion elasticity of not less than 35% nor more than 70%, and said matrix layer has a hardness of not less than 70 nor more than 90 and a modulus of repulsion elasticity of not less than 20% and less than 45%; or said edge layer has a hardness of not less than 70 nor more than 90 and a modulus of repulsion elasticity of not less than 20% and less than 45%, and said matrix layer has a hardness of not less than 60 and less than 75 and a modulus of repulsion elasticity of not less than 35% nor more than 70%.

11. The cleaning blade for use in an image-forming apparatus according to claim 1, wherein said rubber component (1) includes one or more kinds of rubber selected from among acrylonitrile-butadiene rubber (NBR), acrylonitrile-butadiene rubber having a carbonyl group introduced thereinto, hydrogenated acrylonitrile-butadiene rubber (H-NBR), natural rubber (NR), butadiene rubber (BR), styrene-butadiene rubber (SBR), isoprene rubber (IR), butyl rubber (IIR), chloroprene rubber (CR), acrylic rubber (ACM, ANM), epichlorohydrin rubber (ECO), ethylene propylene rubber (EPR), ethylene-propylene-diene copolymer rubber (EPDM), and polyurethane rubber (U).

12. The cleaning blade for use in an image-forming apparatus according to claim 1, wherein said rubber component (1) contains acrylonitrile butadiene rubber or/and hydrogenated acrylonitrile-butadiene rubber (rubber a) in combination with another rubber (rubber b) and that a total mass of said rubber component (1) is 100 parts by mass, a mixing amount of said (rubber a) is 90 to 50 parts by mass and a mixing amount of said (rubber b) is 10 to 50 parts by mass, and 0. 1 to 80 parts by mass of said filler (2) and 0.1 to 30 parts by mass of said crosslinking agent (3) are mixed with 100 parts by mass of said rubber component (1).

* * * * *